US011851864B2

(12) United States Patent
Kuru et al.

(10) Patent No.: US 11,851,864 B2
(45) **Date of Patent: *Dec. 26, 2023**

(54) GRAVITY-FED TOILET WITH QUIET SIPHONIC FLUSH

(71) Applicant: Kohler Co., Kohler, WI (US)

(72) Inventors: William C. Kuru, Plymouth, WI (US); William Kalk, Sheboygan, WI (US)

(73) Assignee: Kohler Co., Kohler, WI (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/084,278

(22) Filed: Dec. 19, 2022

(65) Prior Publication Data

US 2023/0119112 A1 Apr. 20, 2023

Related U.S. Application Data

(63) Continuation of application No. 17/336,876, filed on Jun. 2, 2021, now Pat. No. 11,560,703, which is a continuation of application No. 16/674,937, filed on Nov. 5, 2019, now Pat. No. 11,047,123.

(60) Provisional application No. 62/768,168, filed on Nov. 16, 2018.

(51) Int. Cl.
*E03D 11/02* (2006.01)

(52) U.S. Cl.
CPC ..... *E03D 11/02* (2013.01)

(58) Field of Classification Search
CPC ..... E03D 11/02
USPC ..... 4/420–431, 328, 336, 434, 4
See application file for complete search history.

(56) References Cited

U.S. PATENT DOCUMENTS

| | | | |
|---|---|---|---|
| 2,341,043 | A | 2/1944 | Hoffmann |
| 3,131,402 | A | 5/1964 | Roberts |
| 3,534,415 | A | 10/1970 | Huffman |
| 3,805,304 | A | 4/1974 | Ikehata |
| 4,462,124 | A | 7/1984 | Antos et al. |
| 4,800,596 | A | 1/1989 | Menge |
| 4,933,996 | A | 6/1990 | Sowards |
| 5,029,346 | A | 7/1991 | Fernald, Sr. |
| 5,210,884 | A | 5/1993 | Redford |
| 5,642,533 | A | 7/1997 | Young |
| 6,219,853 | B1 | 4/2001 | Johnson |
| 7,127,749 | B2 | 10/2006 | Ling |
| 7,353,577 | B2 | 4/2008 | Davies et al. |

(Continued)

FOREIGN PATENT DOCUMENTS

| | | | |
|---|---|---|---|
| CN | 2104256 | U | 5/1992 |
| CN | 103362185 | A | 10/2013 |

(Continued)

OTHER PUBLICATIONS

Chinese Office Action for Chinese Application No. 201911126539.0 dated Aug. 26, 2020.

*Primary Examiner* — Lori L Baker
(74) *Attorney, Agent, or Firm* — Lempia Summerfield Katz LLC

(57) ABSTRACT

A toilet includes a bowl, a trapway, and a passage. The trapway is fluidly connected to the bowl at a trapway inlet and extends downstream from the bowl. The trapway includes an up-leg and a down-leg extending downstream from the up-leg. The passage is fluidly connected to the trapway downstream from the trapway inlet. The passage is configured to allow ambient air from outside the toilet to pass therethrough toward the trapway.

20 Claims, 8 Drawing Sheets

(56) References Cited

U.S. PATENT DOCUMENTS

| | | | |
|---|---|---|---|
| 7,644,450 | B2 | 1/2010 | Apossy |
| 7,987,527 | B1 | 8/2011 | Shumaker |
| 9,752,311 | B2 | 9/2017 | Davis et al. |
| 11,047,123 | B2 | 6/2021 | Kuru et al. |
| 11,560,703 | B2 * | 1/2023 | Kuru ..... E03D 11/02 |
| 2005/0028260 | A1 | 2/2005 | Ling |
| 2005/0050621 | A1 | 3/2005 | Thomas |
| 2005/0115042 | A1 | 6/2005 | Davies et al. |
| 2007/0124913 | A1 | 6/2007 | Davies et al. |
| 2014/0059755 | A1 * | 3/2014 | Garrels ..... E03D 1/34 4/363 |
| 2014/0259350 | A1 | 9/2014 | Davis et al. |
| 2015/0013058 | A1 | 1/2015 | Bucher et al. |
| 2015/0197928 | A1 | 7/2015 | Mchale et al. |
| 2015/0267388 | A1 | 9/2015 | Bhardwaj et al. |
| 2015/0376883 | A1 | 12/2015 | Garrels et al. |
| 2017/0152655 | A1 | 6/2017 | Abunameh et al. |

FOREIGN PATENT DOCUMENTS

| | | | |
|---|---|---|---|
| CN | 203244816 | U | 10/2013 |
| GB | 1215368 | A | 12/1970 |
| JP | H0813593 | A | 1/1996 |
| JP | 2007218037 | A | 8/2007 |

* cited by examiner

GRAVITY-FED TOILET WITH QUIET SIPHONIC FLUSH

CROSS-REFERENCE TO RELATED PATENT APPLICATIONS

This application is a Continuation under 35 U.S.C § 120 and 37 C.F.R. § 1.53(b) of U.S. patent application Ser. No. 17/336,876 filed Jun. 2, 2021, which is a Continuation of U.S. patent application Ser. No. 16/674,937, filed Nov. 5, 2019, which claims the benefit of and priority to U.S. Provisional Application No. 62/768,168, filed Nov. 16, 2018, and the entire disclosure of each of which is hereby incorporated by reference herein.

BACKGROUND

The present application relates generally to the field of gravity-fed siphonic toilets, in which water is introduced through gravity to the bowl of the toilet, generating a siphon in a trapway. The present application relates more specifically to breaking the siphon early with a passive bypass passage.

During operation of a conventional gravity toilet, after a large volume of water is introduced to the toilet bowl, water is forced from the bowl downstream through the trapway and generates a siphon in the trapway, pulling the rest of the water from the bowl into the trapway. The siphon continues as long as water completely fills the entire cross section of the trapway near the trapway inlet. When the water level in the bowl drops below the top of the trapway inlet, air is introduced through the trapway inlet into the trapway and stops (i.e., breaks) the siphon. This produces the familiar "gargle" sounds during a flush sequence.

In a conventional gravity-fed toilet, the loudest portion of the flush sequence is when the siphon breaks. This can be difficult to control because structural changes that positively affect the noise of the siphon breaking, such as changing the shape of the trapway, often reduce the flush performance of the toilet as well, which is not desirable. Furthermore, changes to the vitreous material to improve sound deadening properties or the addition of other sound deadening materials to the toilet increase the cost of the toilet and may undesirably reduce the sanitary properties of the toilet.

To the extent that other toilets are able to control the timing of starting and breaking a siphon in a gravity-fed toilet, these generally require active systems that include moving parts, which are susceptible to failure, and require electricity for operation, which limits the locations the toilet may be installed.

Accordingly, it would be advantageous to provide a toilet that introduces air to the trapway to break the siphon prior to the water level in the bowl dropping below the top of the trapway inlet in order to reduce the noise generated from the siphon breaking. It would be further advantageous to provide a toilet with a passive structure rather than an active system for managing the introduction of air.

SUMMARY

One exemplary embodiment of the present disclosure relates to a toilet. The toilet includes a bowl, a trapway, and a passage. The trapway is fluidly connected to the bowl at a trapway inlet and extends downstream from the bowl. The trapway includes an up-leg and a down-leg extending downstream from the up-leg. The passage is fluidly connected to the trapway downstream from the trapway inlet. The passage is configured to allow ambient air from outside the toilet to pass therethrough toward the trapway.

Another exemplary embodiment of the present disclosure relates to a toilet. The toilet includes a pedestal and a passage. The pedestal includes a bowl, a sump, and a trapway. The sump is formed at a lower end of the bowl. The trapway is fluidly connected to the sump at a trapway inlet and extends downstream from the sump. The passage is fluidly connected to the trapway downstream from the trapway inlet. The passage is configured to allow ambient air to pass therethrough toward the trapway as a result of a pressure differential between the trapway and an environment surrounding the toilet.

DETAILED DESCRIPTION

Figure 1:
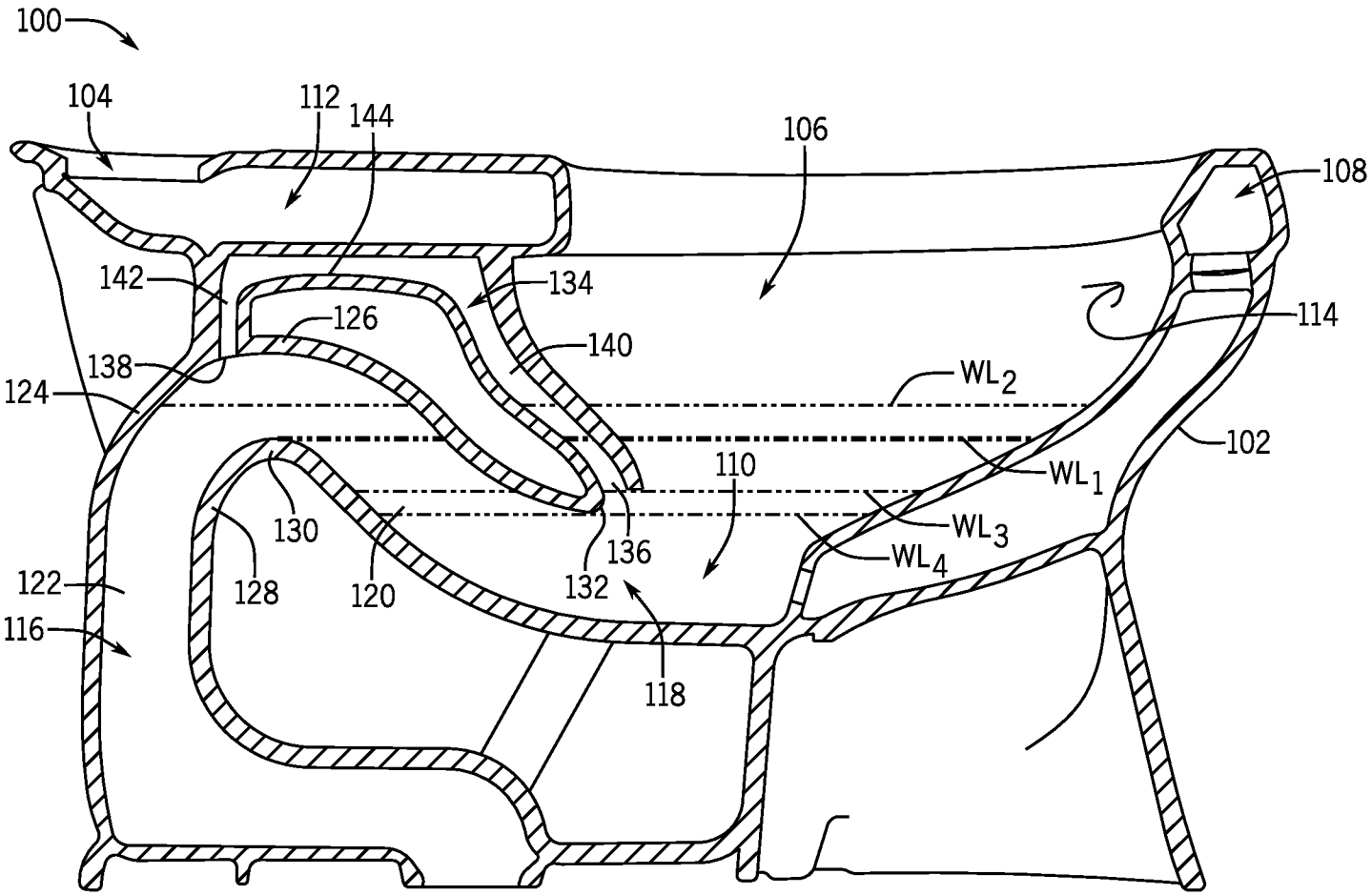
FIG. 1 is a cross-sectional view of a toilet with a trapway and a passage according to an exemplary embodiment.

One embodiment of the present disclosure relates to a toilet including a pedestal having an inlet channel, a rim downstream from the inlet channel, and a bowl downstream from the rim. A sump is formed at a lower end of the bowl and a trapway is fluidly connected to the sump at a trapway inlet and extends downstream from the sump. The toilet further includes a passage having a passage inlet at an upstream end and a passage outlet at a downstream end. The passage inlet is disposed in the bowl at a height above an upper end of the trapway inlet and the passage outlet is disposed in the trapway.

Another embodiment of the present disclosure relates to a toilet including a pedestal having an inlet channel, a rim downstream from the inlet channel, and a bowl downstream from the rim. A sump is formed at a lower end of the bowl and a trapway is fluidly connected to the sump at a trapway inlet and extends downstream from the sump. The toilet further includes a passage having a passage inlet at an upstream end and a passage outlet at a downstream end. The passage inlet is disposed proximate an upstream end of the inlet channel and the passage outlet is disposed in the trapway.

Another embodiment of the present disclosure relates to a toilet including a pedestal having an inlet channel, a rim downstream from the inlet channel, and a bowl downstream from the rim. A sump is formed at a lower end of the bowl and a trapway is fluidly connected to the sump at a trapway inlet and extends downstream from the sump. The toilet further includes a passage having a passage inlet at an upstream end and a passage outlet at a downstream end. The passage inlet is disposed proximate a downstream end of the inlet channel and the passage outlet is disposed in the trapway.

Another embodiment of the present disclosure relates to a toilet including a pedestal having an inlet channel, a rim downstream from the inlet channel, and a bowl downstream from the rim. A sump is formed at a lower end of the bowl and a trapway is fluidly connected to the sump at a trapway inlet and extends downstream from the sump. The toilet further includes a passage having a passage inlet at an upstream end and a passage outlet at a downstream end. The passage inlet is disposed in the rim and the passage outlet is disposed in the trapway.

Another embodiment of the present disclosure relates to a toilet including a pedestal having an inlet channel, a rim downstream from the inlet channel, a bowl downstream from the rim. A sump is formed at a lower end of the bowl and a trapway is fluidly connected to the sump at a trapway inlet and extends downstream from the sump. The toilet further includes a tank upstream from the inlet channel. The toilet further includes a passage having a passage inlet at an upstream end and a passage outlet at a downstream end. The passage inlet is disposed in the tank and the passage outlet is disposed in the trapway.

Another embodiment of the present disclosure relates to a toilet including a pedestal having a bowl, a sump formed at a lower end of the bowl, and a trapway fluidly connected to the sump at a trapway inlet and extends downstream from the sump. The toilet further includes a valve fluidly connected to the trapway and configured to supply air at ambient pressure to the trapway.

Another embodiment of the present disclosure relates to a toilet including a pedestal having a trapway having an up-leg and a down-leg. The toilet further includes a passage fluidly connecting an upstream end of the trapway down-leg and a downstream end of the trapway down-leg.

Another embodiment of the present disclosure relates to a method of flushing a toilet including passing water into a bowl of a toilet and raising a water level in the bowl. The method further includes starting a siphon in the trapway and lowering the water level in the bowl. The method further includes, prior to the water level falling below an upper end of a trapway inlet, exposing the trapway through a passage to air at an ambient pressure in one of an inlet channel, a rim, a bowl, a tank, or an interior portion of the toilet. The method further includes breaking the siphon in the trapway before the water level in the bowl drops below the upper end of the trapway inlet.

Referring to the FIGURES generally, a toilet with a trapway and a passage is shown according to various exemplary embodiments. Throughout this disclosure, the toilets may have similar structures, such that like reference numerals correspond to like features in each of the toilets. Heights of various components may be discussed throughout this disclosure and may refer to a height above a floor or a lower edge of the toilet or may be measured relative to other portions or structures of the toilet. For example, the terms "above," "higher," "over," etc. may refer to a position further away from the floor and the terms "below," "lower," "under," etc. may refer to a position closer to the floor. These terms may further refer to positions along the toilet without regard to lateral position (e.g., side-to-side or front-to-back), such that one portion of the toilet may be above another portion of the toilet, without being aligned vertically.

Referring now to FIG. 1, a toilet 100 is shown according to an exemplary embodiment. The toilet 100 includes a pedestal 102 having an inlet opening 104 configured to receive water from a water source (not shown) for flushing the toilet 100. For example, the water source may be a tank, such that gravity forces water from the tank into the pedestal 102 through the inlet opening 104 (e.g., a gravity-fed toilet). According to another exemplary embodiment the toilet may be a pressure-flush toilet coupled to a water supply line and a flushometer to provide water at a line pressure to the toilet 100 at the inlet opening 104 to induce a siphon for flushing the toilet 100. According to yet another exemplary embodiment, the timing of introducing water to various portions of the toilet 100 may be controlled by one or more valves.

The toilet 100 further includes a bowl 106 having a rim 108 formed at an upper end of the bowl 106 and a sump 110 formed at a lower end of the bowl 106. An inlet channel 112 extends downstream from the inlet opening 104 and is fluidly connected to the rim 108. When water enters the toilet 100, it passes through the inlet opening 104, downstream through the rim 108, and into the bowl 106 from the rim 108, through one or more rim outlets 114. For example, FIG. 1 shows the rim outlet 114 as a single opening, which introduces the water to the bowl 106 in a swirling motion to wash down waste in the bowl 106 toward the sump 110. According to other exemplary embodiments, the rim 108 may include a plurality of rim outlets 114 positioned annularly along the rim 108 for providing water for washing down waste at a plurality of locations in the bowl 106.

Referring still to FIG. 1, the toilet 100 includes a trapway 116, which extends downstream from the sump 110 and is configured to generate a siphon to carry the contents of the bowl 106 (e.g., water and liquid and solid waste) out of the bowl 106. The trapway 116 includes a trapway inlet 118 at, the sump 110 and a trapway up-leg 120, which extends downstream from the trapway inlet 118 at an upward angle relative to the floor. The trapway 116 further includes a trapway down-leg 122, which extends downstream from the trapway up-leg 120 at a downward angle (e.g., vertically downward).

The trapway 116 has a trapway upper surface 124 and an opposing trapway lower surface 128. The trapway upper surface 124 defines an upper peak 126 at the uppermost (i.e., highest) point of the trapway upper surface 124. For example, the upper peak 126 is formed where the trapway up-leg 120 meets the trapway down-leg 122. Similarly, the trapway lower surface 128 defines an upper peak 130 at the uppermost (i.e., highest) point of the trapway lower surface 128. The trapway inlet 118 defines an upper edge 132, which is disposed at a height lower (e.g., below or closer to the floor) than the upper peak 130 of the trapway lower surface 128. Notably, toilets may be required by regulatory code to position the upper edge 132 of the trapway inlet 118 a pre-determined height below the water level WL. For example, a toilet may be required to provide a water level at least approximately one or two inches above the upper edge 132 of the trapway inlet 118 to ensure that a water seal is reliably formed in the trapway 116. As shown in FIG. 1, the water level $WL_1$ of the toilet 100 at rest (e.g., after the completion of a flush sequence) is at the height of the upper peak 130 of the trapway lower surface 128. Specifically, as water is introduced slowly into the bowl 106 (e.g., when the toilet is "running") and does not yet form a siphon, water flows over the upper peak 130 into the trapway down-leg 122, keeping the water level at the upper peak 130 and thereby preventing the bowl 106 from overflowing.

Referring still to FIG. 1, a passage 134 (i.e., break, bypass, vent, secondary passage or conduit, etc.) is shown according to an exemplary embodiment. The passage 134 includes a passage inlet 136 at an upstream end of the passage 134 and a passage outlet 138 at an opposing downstream end of the passage 134. The terms "upstream" and "downstream" indicate that when air flows through the passage 134, the air flows in the direction from the passage inlet 136 to the passage outlet 138.

As shown in FIG. 1, the passage inlet 136 is disposed (i.e., formed, defined, etc.) in the bowl 106, at a height above the upper edge 132 of the trapway inlet 118 and below the upper peak 130 of the trapway lower surface 128. FIG. 1 shows the passage inlet 136 disposed proximate the trapway inlet 118 (e.g., at a rear end of the bowl 106), although according to other exemplary embodiments, the passage inlet 136 may be defined in other portions (e.g., sides or front) of the bowl 106. The passage inlet 136 is disposed below the water level of the toilet 100 at rest. In this configuration, the passage 134 forms a water lock at the passage inlet 136, which prevents noxious waste gas from passing from the trapway down-leg 122, through the passage outlet 138 and upstream through the passage 134 to the passage inlet 136. The passage inlet 136 may be disposed at a pre-determined height below the upper peak 130 of the trapway lower surface 128 and therefore below the water level (e.g., at least one or two inches) to ensure that, a water seal is reliably formed in the passage 134.

Referring still to FIG. 1, the passage outlet 138 is disposed (i.e., formed, defined, etc.) in and fluidly connected to the trapway 116. Specifically, the passage outlet 138 is disposed downstream from the upper peaks 126, 130 of the trapway 116 (e.g., in the trapway down-leg 122). While FIG. 1 shows the passage outlet 138 formed in the trapway upper surface 124, proximate the upper peak 126, it should be understood that according to other exemplary embodiments, the passage outlet 138 may be formed in the trapway lower surface 128 or other surfaces (e.g., side surfaces) of the trapway 116.

While FIG. 1 shows specific locations of the passage inlet 136 and the passage outlet 138, described above, FIGS. 2-8 show the passage inlet 136 and the passage outlet 138 at various locations in the toilet 100. It should be understood that the toilet 100 may be formed with the passage inlet 136 at any of the described positions in the toilet 100, and the passage outlet 138 at any of the described positions in the toilet 100. Accordingly, it is contemplated that the position of each of the passage inlet 136 and the passage outlet 138 should not be limited to only those specific combinations of positions shown in the FIGURES.

Referring still to FIG. 1, the passage 134 includes a passage up-leg 140, which extends downstream from the passage inlet 136 (e.g., toward the passage outlet 138) at an upward angle relative to the floor. The passage 134 further includes a passage down-leg 142, which extends downstream from the passage up-leg 140 at a downward angle. A passage upper peak 144 is defined at the uppermost (i.e., highest) point of a lower surface of the passage 134 (e.g., where the passage up-leg 140 meets the passage down-leg 142). As shown in FIG. 1, the passage upper peak 144 is disposed above the upper peak 126 of the trapway upper surface 124, which ensures that when the water level rises in the toilet 100 during a flush sequence to form a siphon in the trapway 116, the water level does not rise as high as the passage upper peak 144. In this configuration, as long as the water level is above the passage inlet 136, the passage 134 does not affect the formation or breaking of a siphon in the trapway 116.

FIG. 1 shows the passage 134 integrally formed in the pedestal 102, such that the passage 134 is already formed when the vitreous or other material forming the pedestal 102 is cast. It should be understood that the passage 134 may be integrally formed in other portions of the pedestal 102 or the toilet 100 more generally, as will be discussed below. According to other exemplary embodiments, the passage 134 or other passages described with respect to FIGS. 2-8 may be formed as a separate conduit assembly, which is installed in and coupled to the toilet 100. According to yet other exemplary embodiments, portions of the passage 134 may be integrally formed while other portions are separable.

The toilet 100 in FIG. 1 is shown with the water level at a first height (i.e., a first water level $WL_1$) corresponding to a filled position. As discussed above, when the flush sequence is complete, the water level is at the same height as the upper peak 130 of the trapway lower surface 128. When the flush sequence is actuated, a volume of water (e.g., approximately 1.0 gallons, 1.28 gallons, 1.6 gallons, etc.) is introduced rapidly through the inlet opening 104 and passes from the inlet opening 104, through the inlet channel 112 and rim 108, and into the bowl 106. It should be understood that according to other exemplary embodiments, a portion or all of the water may be passed from the inlet channel 112 or other portion of the toilet 100 directly to the sump 110 (e.g., with a sump jet). The rapid introduction of water causes the water level in the bowl 106 to rise to a second height (i.e., a second water level $WL_2$) above the upper peak 130 of the trapway lower surface 128 and below or in contact with the upper peak 126 of the trapway upper surface 124. The water then pours over the upper peak 130 of the trapway lower surface 128 and into the trapway down-leg 122, where it, fills substantially an entire cross-section of at least a portion of the trapway down-leg 122 with a high flow rate. The increased flow rate of water in the trapway 116 reduces the downstream (e.g., in the trapway down-leg 122) pressure in the trapway 116 to a siphon pressure, which is less than an ambient (e.g., atmospheric) pressure, causing a siphon to form, and evacuating the contents from the bowl 106.

As the water level rises in the trapway 116, it also rises a corresponding amount in the passage up-leg 140. However, the flow of water to the trapway down-leg 122 and particularly the formation of the siphon in the trapway 116 prevents the water level from continuing to rise in the passage 134. Notably, the siphon is formed prior to the water level reaching the passage upper peak 144. As a result, waste is never passed through the passage 134 and a siphon is not formed therein during the flush sequence. According to another exemplary embodiment, low pressure in the trapway 116 proximate the passage outlet 138 causes a siphon to form in the passage 134, drawing water through the passage 134 from the passage inlet 136 to the passage outlet 138, even if the water level in the bowl 106 does not reach a height that is level with or above the passage upper peak 144. It should further be understood that even if a siphon is formed in the passage 134, substantially more water passes through the trapway 116 than through the passage 134, such that the water entering the trapway 116 at the trapway inlet 118 continues to form the siphon, regardless of the formation of a siphon in the passage 134. The passage 134 may further be configured in other ways to prevent waste entering the passage inlet 136, through the passage 134.

Either before or after the formation of the siphon in the trapway 116, the supply of water to the toilet 100 is stopped and the siphon continues to evacuate the water and waste in the bowl 106, through the trapway up-leg 120 and the trapway down-leg 122 and out to a drain. As water is pulled out of the bowl 106 with the siphon, the water level drops in the bowl 106. In the configuration in which a siphon is not formed in the passage 134, the water level drops by the substantially the same distance in the passage 134 as in the bowl until the water level reaches a third height (i.e., a third water level $WL_3$) at the height of the passage inlet 136. When the water level drops to or below the height of the passage inlet 136, the passage inlet 136 is exposed to ambient air above the water in the bowl 106 and the water seal on the passage 134 is broken. The ambient air, which is at a higher pressure than the siphon pressure in the trapway 116 proximate the passage outlet 138, enters the passage 134 through the passage inlet 136 and is output from the passage outlet 138 into the trapway 116. The sudden introduction of the air to the trapway 116 causes the pressure in the trapway 116 to equalize with the ambient pressure, eliminating the pressure differential between the downstream portion of the trapway 116 and the bowl 106, thereby breaking (e.g., partially or completely) the siphon. Momentum from the water moving in the trapway up-leg 120 may continue to carry additional water and/or waste out of trapway up-leg 120 and/or the sump 110 for output to a drain.

According to an exemplary embodiment, in which a siphon is formed in both the trapway 116 and the passage 134, the introduction of air to the passage 134 first breaks the siphon in the passage 134 and then subsequently breaks the siphon in the trapway 116 as discussed above. Specifically, the passage 134 has a smaller cross-sectional area than the trapway 116 and holds a smaller volume of water than the trapway 116. As the siphon operates in the passage 134, the water is evacuated from the passage 134, out through the passage outlet 138 into the trapway 116. Once the water level drops below the third height $WL_3$, the bowl 106 stops supplying water to the siphon in the passage 134. Due to the small volume of water held in the passage 134, substantially all of the water in the passage 134 is completely output from the passage 134 into the trapway 116 before the water level in the bowl 106 reaches or drops below the upper edge 132 of the trapway inlet 118 ($WL_4$), thereby breaking the siphon, as will be discussed in further detail below.

After the water level first reaches the third height ($WL_3$), it may take a period of time to fully equalize the pressure (i.e., eliminate the pressure differential) between the trapway 116 proximate the passage outlet 138 and ambient pressure. Notably, at least a portion of the trapway 116 may be at an intermediate pressure, which is greater than the siphon pressure and less than ambient pressure. While a pressure differential still exists between the intermediate pressure and ambient pressure, the siphon may continue at a slower rate and the water level will continue to drop. As the water level drops, it then reaches a fourth height (i.e., a fourth water level $WL_4$), which is at or below the height of the upper edge 132 of the trapway inlet 118. When the water level reaches the fourth height ($WL_4$), ambient air then passes directly into the trapway 116 at the trapway inlet 118, completely breaking the siphon.

In a conventional toilet, the pressure differential when the water level reaches the upper edge 132 of the trapway inlet 118 is the difference between the siphon pressure and ambient pressure (e.g., the pressure of the ambient air in an environment surrounding the toilet). This pressure differential causes air to rush into the trapway 116, generating significant turbulence and resultant noise in the water in the sump 110. In the configuration shown in FIG. 1, by reducing or eliminating the pressure differential before the water level reaches the upper edge 132 of the trapway inlet 118, less or no ambient air passes into the trapway 116 through the sump 110. In other words, the pressure differential between the siphon pressure in the trapway 116 and ambient pressure is less than in a conventional toilet when the water level reaches the upper edge 132 of the trapway inlet 118. The reduction or elimination of air flowing through the trapway inlet 118 significantly reduces or eliminates the noise (e.g., the "gurgle" sound) associated with the siphon breaking, thereby providing quieter flush action in the toilet 100. It will be appreciated that this noise reduction may be provided with the various other configurations, discussed below.

Figure 2:
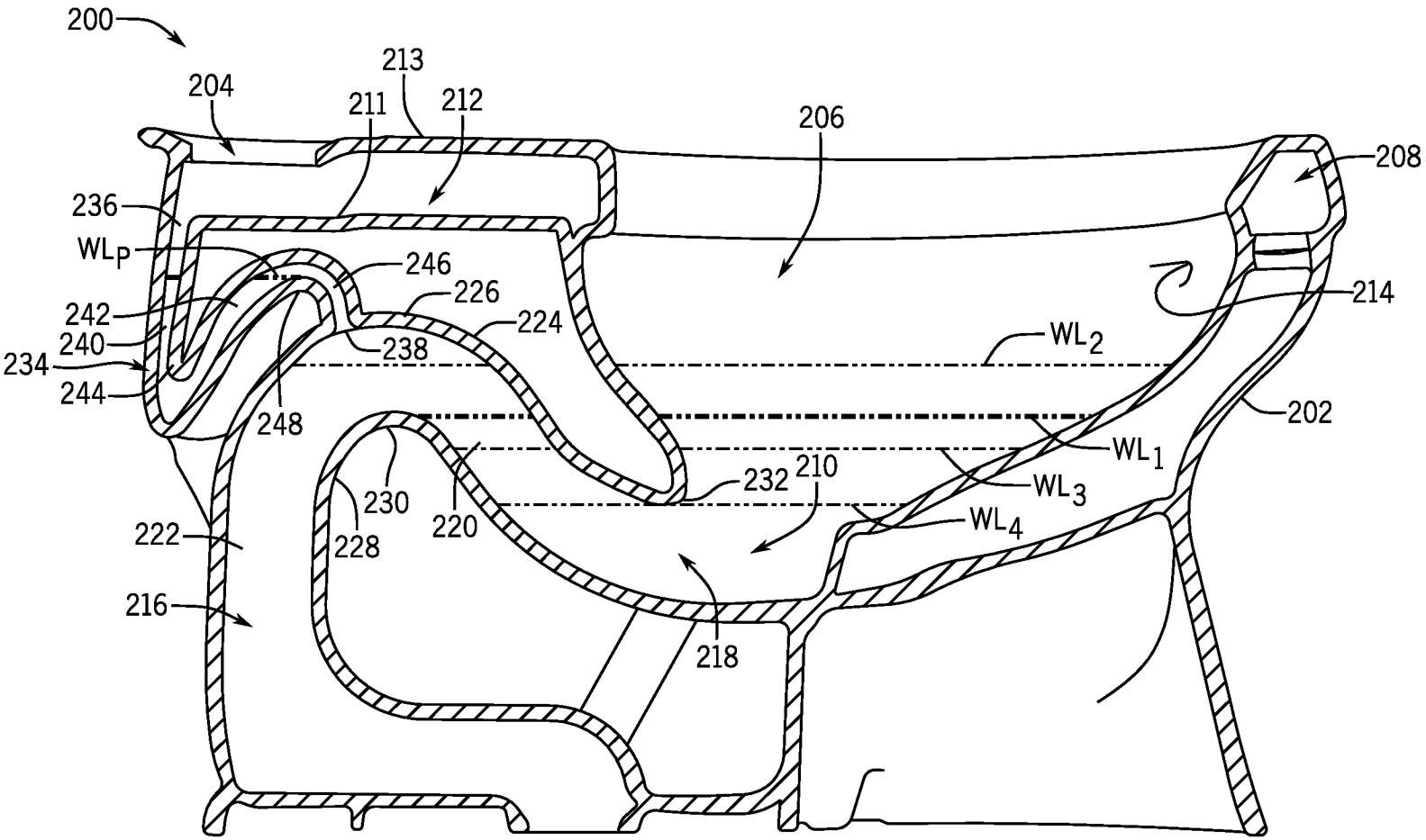
FIG. 2 is a cross-sectional view of a toilet with a trapway and a passage according to another exemplary embodiment.

Referring now to FIG. 2, a toilet 200 is shown according to an exemplary embodiment. The toilet 200 is substantially similar to the toilet 100 shown in FIG. 1, such that like reference numerals may indicate like features and/or portions of the toilet 100. For example, the toilet 200 includes a pedestal 202, having an inlet opening 204, a rim 208, an inlet channel 212, a bowl 206, a sump 210, and a trapway 216, which are substantially similar to the pedestal 102, inlet opening 104, rim 108, inlet channel 112 bowl 106, sump 110, and trapway 116, respectively of the toilet 100 shown in FIG. 1.

Referring still to FIG. 2, a passage 234 (i.e., break, bypass, vent, secondary passage or conduit, etc.) is shown according to an exemplary embodiment. The passage 234 includes a passage inlet 236 at, an upstream end of the passage 234 and a passage outlet 238 at an opposing downstream end of the passage 234. The passage 234 is disposed in the pedestal 202, between and fluidly connecting the inlet channel 212 and the trapway 216.

As shown in FIG. 2, the passage inlet 236 is disposed (i.e., formed, defined, etc.) in the inlet channel 212. FIG. 2 shows the passage inlet 236 proximate the inlet opening 204 at an upstream end of the inlet channel 212, although according to other exemplary embodiments, the passage inlet 236 may be disposed in other portions (e.g., middle portion, downstream end, etc.) of the inlet channel 212. Similarly, FIG. 2 shows the passage inlet 236 disposed in an inlet channel lower surface 211 but according to other exemplary embodiments, the passage inlet 236 may be disposed in an inlet channel upper surface 213 or other surfaces (e.g., side surfaces) firming the inlet channel 212.

The passage outlet 238 is disposed (i.e., formed, defined, etc.) in and fluidly connected to the trapway 216. Specifically, the passage outlet 238 is disposed downstream from the upper peaks 226, 230 of the trapway 216 (e.g., the passage outlet 238 is disposed in the trapway down-leg 222). While FIG. 2 shows the passage outlet 238 formed in the trapway upper surface 224, proximate the upper peak 226, it should be understood that according to other exemplary embodiments, the passage outlet 238 may be formed in the trapway lower surface 228 or other surfaces (e.g., side surfaces) of the trapway 216.

Referring still to FIG. 2, the passage 234 includes a passage first down-leg 240, which extends downstream from the passage inlet 236 (e.g., toward the passage outlet 238) at a downward angle (e.g., approximately vertically downward) relative to the floor. The passage 234 further includes a passage up-leg 242, which extends downstream from the passage first down-leg 240 at an upward angle. A passage valley (i.e., lower peak) 244 is defined at the lowermost (i.e., lowest) point of an upper surface of the passage 234 (e.g., where the passage first down-leg 240 meets the passage up-leg 242). The passage 234 further includes a passage second down-leg 246, which extends downstream from the passage up-leg 242 at a downward angle and terminates at the passage outlet 238. A passage upper peak 248 is defined at the uppermost (i.e., highest) point of a lower surface of the passage 234 (e.g., where the passage up-leg 242 meets the passage second down-leg 246).

As shown in FIG. 2, the passage valley 244 is disposed below the passage upper peak 248. When the flush sequence is complete, water rests in the passage 234 at a passage water level $WL_P$, which is level with or below the passage upper peak 248 and above the passage valley 244. The water in the passage 234 is disposed in at least a portion of the passage first down-leg 240 and the passage up-leg 242, thereby forming a water lock and preventing noxious waste gas from passing from the trapway 216, upstream through the passage 234 to the passage to the inlet channel 212, and out through the rim outlet 214 or a tank at the inlet opening 204, where it could be released into the atmosphere contrary to code requirements.

The passage upper peak 248 is disposed above the upper peak 226 of the trapway upper surface 224. In this configuration, when a siphon is formed in the trapway 216 and the water level in the trapway 216 rises all the way to the upper peak 226, the waste water does not rise high enough to flow over the passage upper peak 248 and upstream through the passage 234 to the inlet channel 212. This configuration is important to ensure that waste water does not recirculate through the passage 234 and back into the bowl 206 during a flush sequence.

Figure 3:
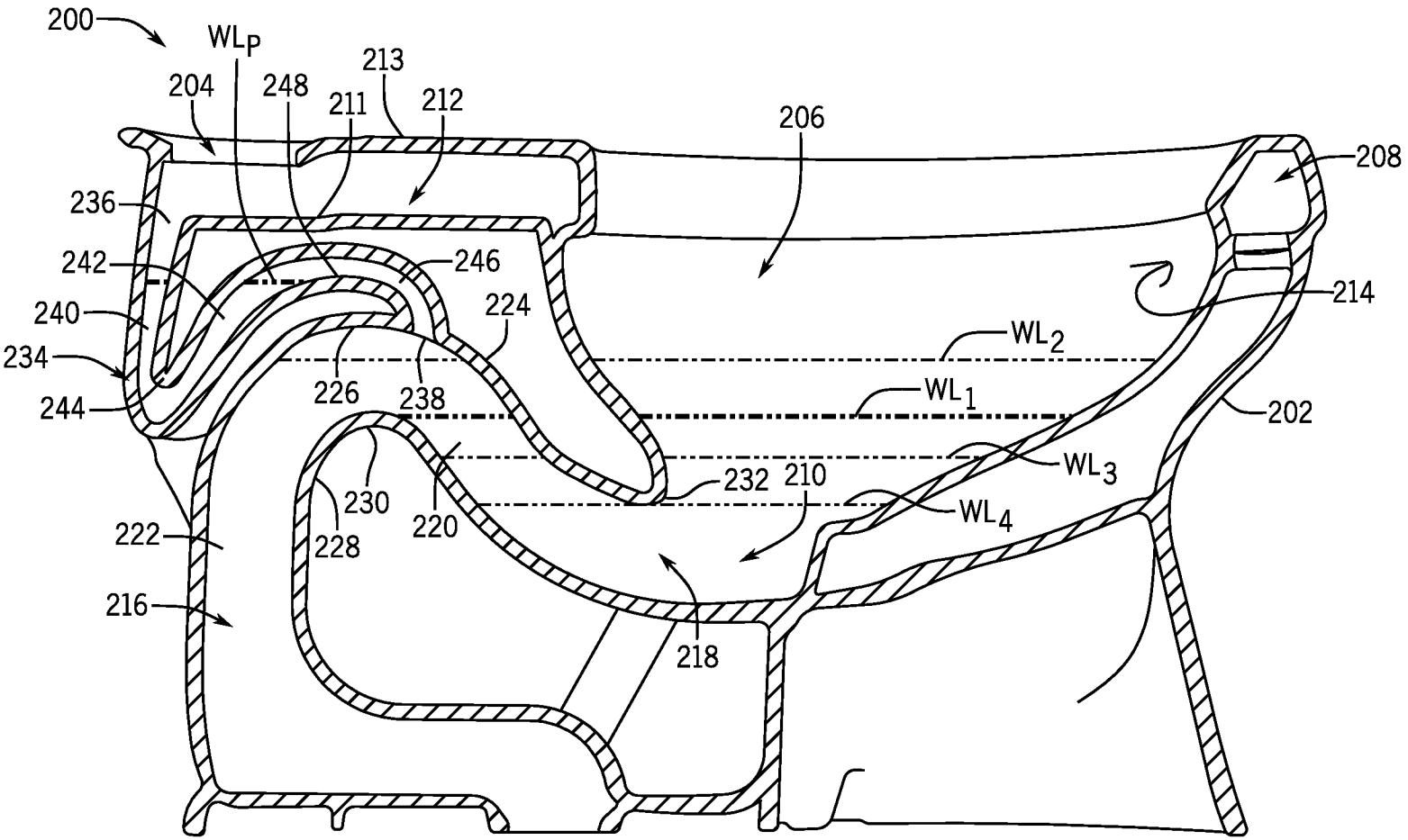
FIG. 3 is a cross-sectional view of a toilet with a trapway and a passage according to another exemplary embodiment.

Referring now to FIG. 3, the toilet 200 is shown according to another exemplary embodiment. The toilet 200 is substantially similar to the toilet 200 shown in FIG. 2, such that like reference numerals may indicate like features and/or portions of the toilet 200. Referring still to FIG. 3, a passage 234 (i.e., break, bypass, vent, secondary passage or conduit, etc.) is shown according to an exemplary embodiment. The passage 234 includes a passage inlet 236 at an upstream end of the passage 234 and a passage outlet 238 at an opposing downstream end of the passage 234. The passage 234 is disposed in the pedestal 202, between and fluidly connecting the inlet channel 212 and the trapway 216.

As shown in FIG. 3, the passage inlet 236 is disposed (i.e., formed, defined, etc.) in the inlet channel 212. FIG. 2 shows the passage inlet 236 proximate the inlet opening 204 at an upstream end of the inlet channel 212, although according to other exemplary embodiments, the passage inlet 236 may be disposed in other portions (e.g., middle portion, downstream end, etc.) of the inlet channel 212. Similarly, FIG. 3 shows the passage inlet 236 disposed in an inlet channel lower surface 211 but according to other exemplary embodiments, the passage inlet 236 may be disposed in an inlet channel upper surface 213 or other surfaces (e.g., side surfaces) forming the inlet channel 212.

The passage outlet 238 is disposed (i.e., formed, defined, etc.) in and fluidly connected to the trapway 216. Specifically, the passage outlet 238 is disposed proximate and upstream from the upper peaks 226, 230 of the trapway 216 (e.g., the passage outlet 238 is disposed in the trapway down-leg 222). While FIG. 3 shows the passage outlet 238 formed in the trapway upper surface 224, proximate the upper peak 226, it should be understood that according to other exemplary embodiments, the passage outlet 238 may be formed in the trapway lower surface 228 or other surfaces (e.g., side surfaces) of the trapway 216. According to yet another exemplary embodiment, the passage outlet 238 may be disposed in any portion of the trapway up-leg 220, such that the passage upper peak 248 is positioned above one or both of the upper peaks 226, 230.

It should be understood that the timing of breaking the siphon in the trapway 216 may be determined and/or controlled based on the position of the passage outlet 238 in the trapway 216. Specifically, the lower pressure (e.g., siphon pressure) region is generally downstream from the upper peak 230 of the trapway lower surface 228, where gravity helps accelerate the water in the trapway down-leg 222, relative to the flow rate of the water in the trapway up-leg 220. The siphon in the trapway breaks when the pressure in the trapway down-leg 222 suddenly increases to a higher pressure (e.g., ambient pressure) due to exposure to an air supply at that higher pressure. Specifically, the siphon begins to break when the air reaches the lower pressure region in the trapway down-leg 222. As shown in FIG. 2, the passage outlet 238 is disposed in the trapway down-leg 222, such that the air is introduced from the passage 234 directly into the trapway down-leg 222. In this configuration, there should be little or no delay between the time air is output from the passage 234 and when the siphon begins to break.

With respect to FIG. 3, the passage outlet 238 is further upstream (e.g., in the trapway up-leg 220) from the passage outlet 238 as shown in FIG. 2. In the configuration shown in FIG. 3, when air is first introduced to the trapway 216 from the passage 234, the siphon continues to operate. Air then travels downstream in the trapway 216 from the passage outlet 238 until it reaches the lower pressure region in the trapway down-leg 222, at which point the siphon begins to break. According to various exemplary embodiments, the air from the passage 234 may be carried downstream in the trapway 216 at substantially the same or a different velocity as the water flowing in the trapway 216. It should be understood that breaking the siphon in the trapway 216 can be delayed by positioning the passage outlet 238 further upstream in the trapway 216. For example, the further upstream that the passage outlet 238 is disposed in the trapway 216, the longer the delay between a siphon breaking in the passage 234 and the siphon breaking in the trapway 216.

Figure 4:
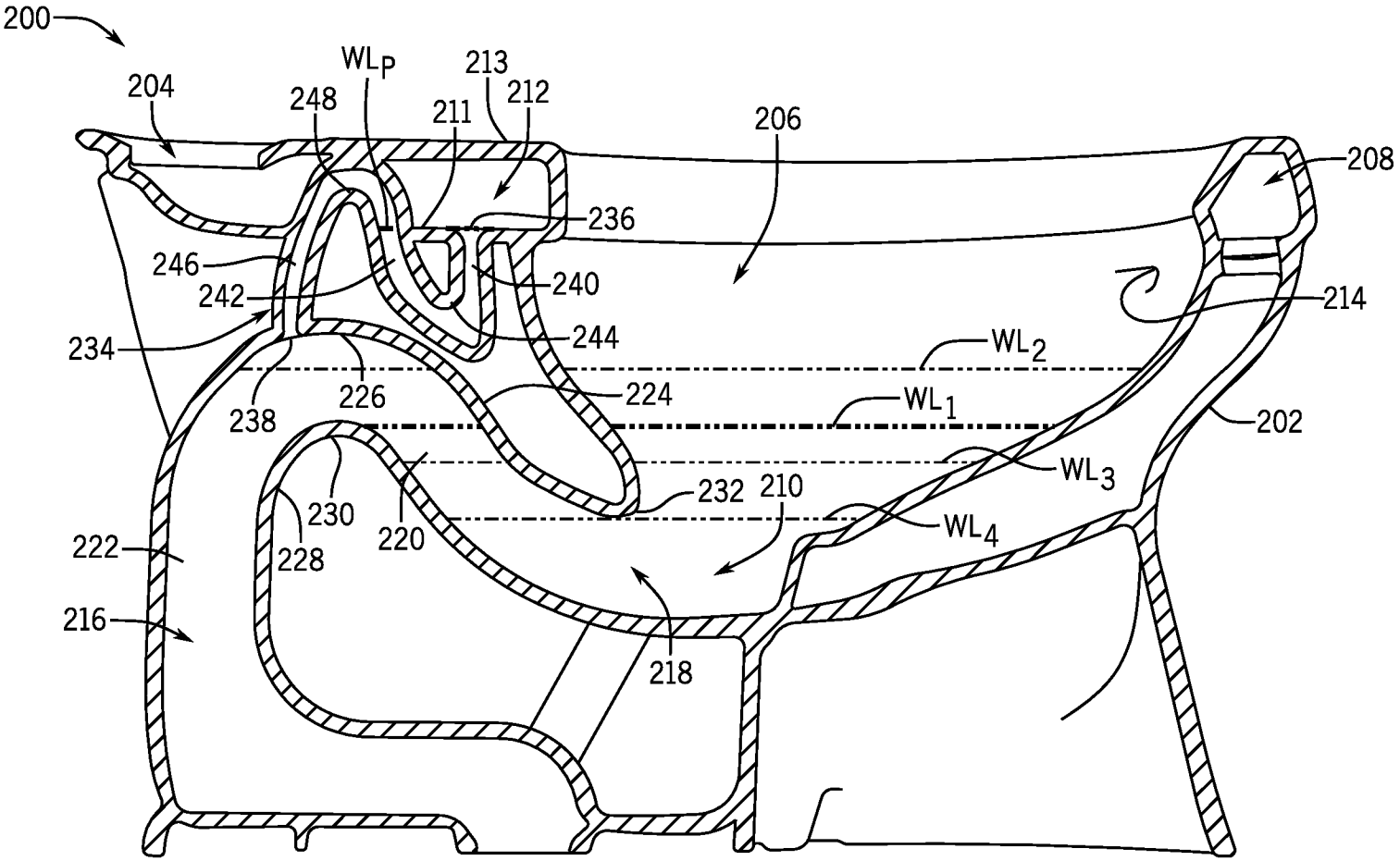
FIG. 4 is a cross-sectional view of a toilet with a trapway and a passage according to another exemplary embodiment.

Referring now to FIG. 4, the toilet 200 is shown according to another exemplary embodiment. The toilet 200 is substantially similar to the toilet 200 shown in FIGS. 2 and 3, such that like reference numerals may indicate like features and/or portions of the toilet 200. Referring still to FIG. 4, a passage 234 (i.e., break, bypass, vent, secondary passage or conduit, etc.) is shown according to an exemplary embodiment. The passage 234 includes a passage inlet 236 at an upstream end of the passage 234 and a passage outlet 238 at an opposing downstream end of the passage 234. The passage 234 is disposed in the pedestal 202, between and fluidly connecting the inlet channel 212 and the trapway 216.

As shown in FIG. 4, the passage inlet 236 is disposed (i.e., formed, defined, etc.) in the inlet channel 212. While FIGS. 2 and 3 shows the passage inlet 236 proximate the inlet opening 204 at an upstream end of the inlet channel 212, in FIG. 4, the passage inlet 236 is disposed at a downstream end of the inlet channel 212. Further FIG. 4 shows the passage inlet 236 disposed in an inlet channel lower surface 211 but according to other exemplary embodiments, the passage inlet 236 may be disposed in an inlet channel upper surface 213 or other surfaces (e.g., side surfaces) forming the inlet channel 212.

The passage outlet 238 is disposed (i.e., formed, defined, etc.) in and fluidly connected to the trapway 216. Specifically, the passage outlet 238 is disposed proximate and downstream from the upper peaks 226, 230 of the trapway 216 (e.g., in the trapway down-leg 222). While FIG. 4 shows the passage outlet 238 formed in the trapway upper surface 224, proximate the upper peak 226, it should be understood that according to other exemplary embodiments, the passage outlet 238 may be formed in the trapway lower surface 228 or other surfaces (e.g., side surfaces) of the trapway 216. According to yet another exemplary embodiment, the passage outlet 238 may be disposed in any portion of the trapway up-leg 220, such that the passage upper peak 248 is positioned above one or both of the upper peaks 226, 230.

It should be understood that the timing of breaking the siphon in the trapway 216 may also be determined and/or controlled based on the position of the passage inlet 236 in the trapway 216. Specifically, the timing may be controlled relative to where water is present in the inlet channel 212. As will be discussed in further detail below, as long as water is flowing in the inlet channel 212, the siphon in the trapway 216 is able to continue operating without being broken early. When the supply of water to the inlet channel 212 is stopped, the water already present in the inlet channel 212 continues to flow downstream toward the rim 208. This flow direction means that the upstream end of the inlet channel 212 is exposed to ambient air before the downstream end of the inlet channel 212. As a result, the siphon in the trapway 216 would break later during the flush sequence, the further downstream in the inlet channel 212 or other portions of the toilet 200 (e.g., in the rim 208) that the passage inlet 236 is positioned. For example, the siphon in the configuration shown in FIG. 4 may break later during the flush sequence than in the configuration shown in FIG. 2 because the passage inlet 236 is further downstream in the inlet channel 212.

The toilets 200 in FIGS. 2-4 are shown with the water level in the bowl 206 at a first height (i.e., a first water level $WL_1$) corresponding to a filled position. As discussed above, when the flush sequence is complete, the water level is at the same height as the upper peak 230 of the trapway lower surface 228. When the flush sequence is actuated, a volume of water approximately 1.0 gallons, 1.28 gallons, 1.6 gallons, etc.) is introduced rapidly through the inlet opening 204 and into the inlet channel 212. The high flow rate of water into the inlet channel 212 reduces the pressure in the inlet channel 212. According to an exemplary embodiment, a portion of the water introduced to the inlet channel 212 passes into the passage 234 through the passage inlet 236, raising the water level of the water lock in the passage 234. As the water flows over the passage upper peak 248, a siphon is formed in the passage 234, continuing to draw water from the inlet channel 212 and output the water into the trapway 216. This additional flow of water may have a minimal effect in inducing the formation of a subsequent siphon in the trapway 216.

The remaining portion of the water introduced to the inlet channel 212 then passes to the rim 208, and into the bowl 206. It should be understood that according to other exemplary embodiments, a portion or all of the water in the inlet channel 212 may be passed directly to the sump 210 (e.g., with a sump jet) or other portion of the toilet 200.

While water continues to be introduced to the inlet channel 212, the rapid introduction of water to the bowl 206 causes the water level in the bowl 206 to rise to a second height (i.e., a second water level $WL_2$) above the upper peak 230 of the trap ay lower surface 228 and below or in contact with the upper peak 226 of the trapway upper surface 224. The water then pours over the upper peak 230 of the trapway lower surface 228 and into the trapway down-leg 222, where it fills substantially an entire cross-section of at least a portion of the trapway down-leg 222 with a high flow rate. The increased flow rate of water in the trapway 216 reduces the downstream (e.g., in the trapway down-leg 222) pressure in the trapway 216 to a siphon pressure, which is less than an ambient pressure, causing a siphon to form, and evacuating the contents from the bowl 206.

After the siphon is formed in the trapway 216 and before the supply of water to the inlet channel 212 is stopped, the siphon in the trapway 216 evacuates the water and waste in the howl 206, through the trapway up-leg 220 and the trapway down-leg 222 and out to the drain. As water is pulled out of the bowl 206 with the siphon, the water level drops in the bowl 206. When the water level in the bowl 206 is at a third height (i.e., a third water level $WL_3$), between the upper peak 230 of the trapway lower surface 228 and the upper edge 232 of the trapway inlet 218 (i.e., before the water level in the bowl falls below the upper edge 232 of the trapway inlet 218), the supply of water to the inlet channel 212 is stopped. Because water is no longer supplied to the inlet channel 212, at least not at a high enough rate to continue to fill the passage 234 at the rate that the passage 234 outputs water to the trapway 216, the siphon in the passage 234 continues to operate until the passage water level drops below the passage valley 244 or until all of the water in the passage 234 is evacuated.

The reduction of water in the inlet channel 212 also returns the inlet channel pressure to approximately ambient pressure. When the passage water level drops to or below the height of the passage valley 244, the entire passage 234 is exposed to the air in the inlet channel 212 at ambient pressure. Because air at ambient pressure is at a higher pressure than the siphon pressure in the trapway 216 proximate the passage outlet 238, the air enters the passage 234 from the inlet channel 212, through the passage inlet 236, and is output from the passage outlet 238 into the trapway 216. The sudden introduction of the air to the trapway 216 causes the pressure in the trapway 216 to equalize with ambient pressure, eliminating the pressure differential between the downstream portion of the trapway and the bowl 206, which is also at ambient pressure, thereby breaking (e.g., partially or completely) the siphon. Momentum from the water moving in the trapway up-leg 220 may continue to carry additional water and/or waste out of trapway up-leg 220 and/or the sump 210 for output to a drain.

According to another exemplary embodiment, after the water is stopped in the inlet channel 212 and/or the siphon in the passage 234 is completed, it may take a period of time to fully equalize the pressure (i.e., eliminate the pressure differential) between the trapway 216 proximate the passage outlet 238 and ambient pressure. Notably, at least a portion of the trapway 216 may be at an intermediate pressure, which is greater than the siphon pressure and less than ambient pressure. While a pressure differential still exists between the intermediate pressure and ambient pressure, the siphon may continue at a slower rate and the water level will continue to drop. As the water level drops, it then reaches a fourth height (i.e., a fourth water level $WL_4$), which is at or below the height of the upper edge 232 of the trapway inlet 218. When the water level reaches the fourth height, ambient air then passes directly into the trapway 216 at the trapway inlet 218, completely breaking the siphon.

According to another exemplary embodiment, the passage inlet 236 may be disposed in the inlet channel 212, such that water does not flow into the passage 234 when the flush sequence is first actuated. For example, the inlet opening 204 and inlet channel 212 may be configured to maintain a high-speed laminar flow past the passage inlet 236, such that water is not diverted into the passage inlet 236 until the flow rate decreases as the amount of water left in the water supply (e.g., a tank) decreases and the boundary layer of the water separates. According to another exemplary embodiment, the passage inlet 236 may be disposed in the upper surface 213 of the inlet channel 212, such that gravity prevents the flush water from entering the passage inlet 236 during the flush sequence. In this configuration, a siphon is not formed in the passage 234 due only to the introduction of water to the inlet channel 212.

After the siphon is formed in the trapway 216 and before the supply of water to the inlet channel 212 is stopped, the siphon in the trapway 216 evacuates the water and waste in the howl 206, through the trapway up-leg 220 and the trapway down-leg 222 and out to the drain. As water is pulled out of the bowl 206 with the siphon, the water level drops in the bowl 206. When the water level in the bowl 206 is at a third height (i.e., a third water level $WL_3$), between the upper peak 230 of the trapway lower surface 228 and the upper edge 232 of the trapway inlet 218 (i.e., before the water level in the bowl falls below the upper edge 232 of the trapway inlet 218), the supply of water to the inlet channel 212 is stopped.

When the water stops flowing into the inlet channel 212, the inlet channel pressure increases to approximately ambient pressure, forming a pressure differential between the passage inlet 236 at ambient pressure and the passage outlet 238 at the lower siphon pressure. This pressure differential causes the water in the passage 234 to flow downstream, through the passage outlet 238 and into the trapway 216, after water has stopped flowing through the inlet channel 212. According to yet another exemplary embodiment, the siphon pressure in the trapway 216 may be less than the inlet channel pressure, such that the pressure differential causes the water in the passage 234 to flow downstream, even while water is flowing through the inlet channel 212.

When the passage water level drops to or below the height of the passage valley 244, the entire passage 234 is exposed to the air in the inlet channel 212 at ambient pressure. Because air at ambient pressure is at a higher pressure than the siphon pressure in the trapway 216 proximate the passage outlet 238, the air enters the passage 234 from the inlet channel 212, through the passage inlet 236, and is output from the passage outlet 238 into the trapway 216. The sudden introduction of the air to the trapway 216 causes the pressure in the trapway 216 to equalize with ambient pressure, eliminating the pressure differential between the downstream portion of the trapway and the bowl 206, which is also at ambient pressure, thereby breaking (e.g., partially or completely) the siphon. Momentum from the water moving in the trapway up-leg 220 may continue to carry additional water and/or waste out of trapway up-leg 220 and/or the sump 210 for output to a drain.

In the event that enough water is evacuated from the passage 234, such that the passage water level is below the passage valley 244, water is supplied to the passage 234 through the passage inlet 236. The water may be supplied during a re-filling (e.g., resetting) portion or other portion of the flush sequence, causing the passage water level to rise. As the passage water level rises back above the passage valley 244, the water lock is firmed once again in the passage 234 and prevents noxious waste gas from exiting the trapway 216, through the passage 234.

Figure 5:
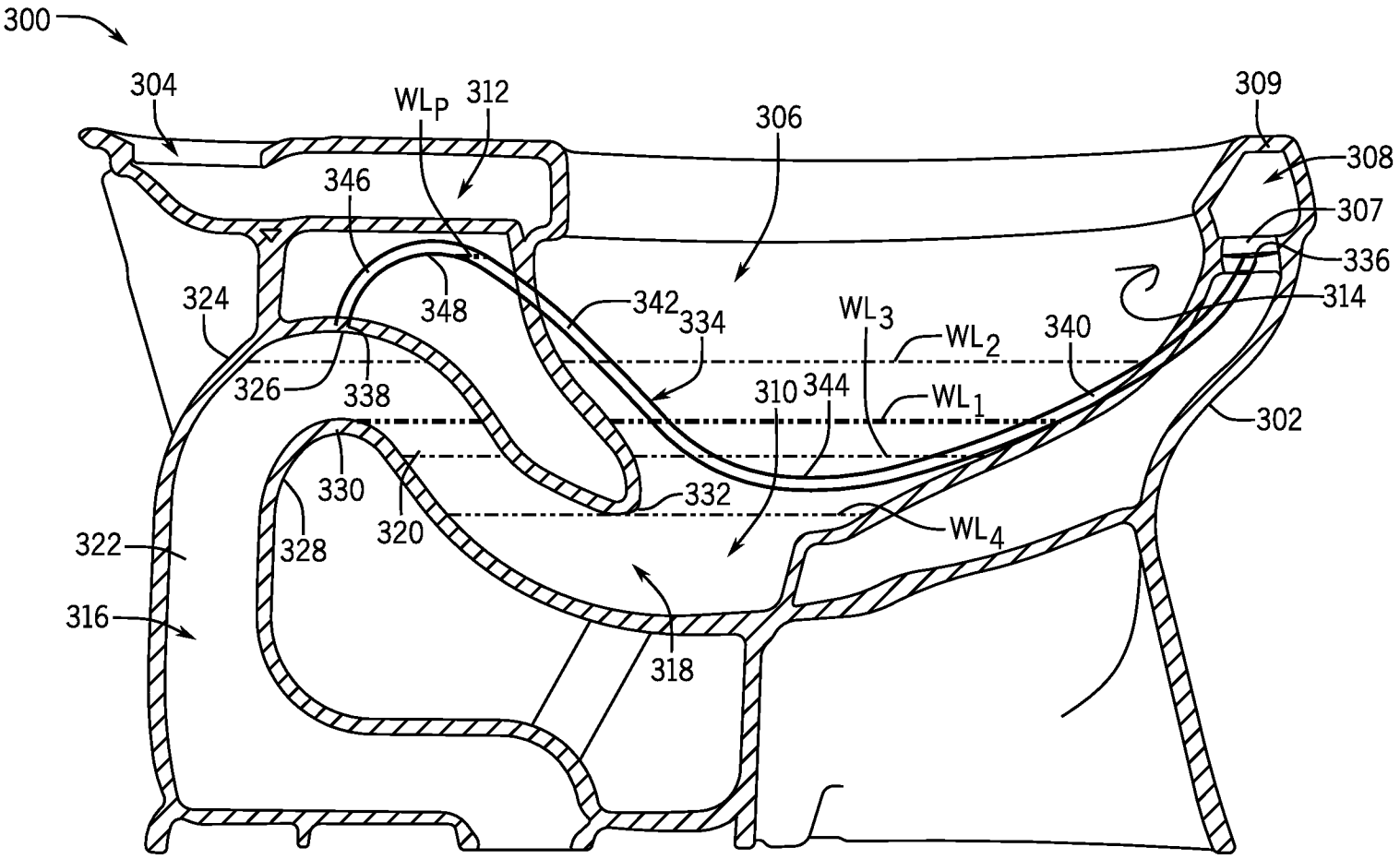
FIG. 5 is a cross-sectional view of a toilet with a trapway and a passage according to another exemplary embodiment.

Referring now to FIG. 5, a toilet 300 is shown according to an exemplary embodiment. The toilet 300 is substantially similar to the toilet 200 shown in FIGS. 2-4, such that like reference numerals may indicate like features and/or portions of the toilet 200. For example, the toilet 300 includes a pedestal 302, having an inlet opening 304, a rim 308, an inlet channel 312, a bowl 306, a sump 310, and a trapway 316, which are substantially similar to the pedestal 202, inlet opening 204, rim 208, inlet channel 212 bowl 206, sump 210, and trapway 216, respectively of the toilet 200 shown in FIGS. 2-4.

Referring still to FIG. 5, a passage 334 (i.e., break, bypass, vent, secondary passage or conduit, etc.) is shown according to an exemplary embodiment. The passage 334 includes a passage inlet 336 at an upstream end of the passage 334 and a passage outlet 338 at an opposing downstream end of the passage 334. The passage 334 is disposed in the pedestal 302, between and fluidly connecting the rim 308 and the trapway 316.

As shown in FIG. 5, the passage inlet 336 is disposed (i.e., formed, defined, etc.) in the rim 308. FIG. 5 shows the passage inlet 336 proximate a forward (e.g., downstream) end of the rim 308, proximate the rim outlet 314, although according to other exemplary embodiments, the passage inlet 336 may be disposed in other portions (e.g., middle portion, rear or upstream end, etc.) of the rim 308. Similarly, FIG. 5 shows the passage inlet 336 disposed in a rim lower surface 307 but according to other exemplary embodiments, the passage inlet 336 may be disposed in a rim upper surface 309 or other surfaces (e.g., side surfaces) forming the rim 308.

The passage outlet 338 is disposed (i.e., formed, defined, etc.) in and fluidly connected to the trapway 316. Specifically, the passage outlet 338 is disposed proximate the upper peaks 326, 330 of the trapway 316. According to another exemplary embodiment, the passage outlet 338 may be disposed upstream from the upper peaks 326, 330 (e.g., in the trapway up-leg 320), similarly to the configuration shown in FIG. 3. According to yet another exemplary embodiment, the passage outlet 338 may be disposed downstream from the upper peaks 326, 330 (e.g., in the trapway down-leg 322), similar to the configuration shown in FIGS. 2 and 4. While FIG. 5 shows the passage outlet 338 formed in the trapway upper surface 324, proximate the upper peak 326, it should be understood that according to other exemplary embodiments, the passage outlet 338 may be formed in the trapway lower surface 328 or other surfaces (e.g., side surfaces) of the trapway 316.

Referring still to FIG. 5, the passage 334 includes a passage first down-leg 340, which extends downstream from the passage inlet 336 (e.g., toward the passage outlet 338) at a downward angle approximately vertically downward) relative to the floor. The passage 334 further includes a passage up-leg 342, which extends downstream from the passage first down-leg 340 at an upward angle. A passage valley (i.e., lower peak) 344 is defined at the lowermost (i.e., lowest) point of an upper surface of the passage 334 (e.g., where the passage first down-leg 340 meets the passage up-leg 342). The passage 334 further includes a passage second down-leg 346, which extends downstream from the passage up-leg 342 at a downward angle and terminates at the passage outlet 338. A passage upper peak 348 is defined at the uppermost (i.e., highest) point of a lower surface of the passage 334 (e.g., where the passage up-leg 342 meets the passage second down-leg 346).

As shown in FIG. 5, the passage valley 344 is disposed below the passage upper peak 348. When the flush sequence is complete, water rests in the passage 334 at a passage water level $WL_P$, which is level with or below the passage upper peak 348 and above the passage valley 344. The water in the passage 334 is disposed in at least a portion of the passage first down-leg 340 and the passage up-leg 342, thereby forming a water lock and preventing noxious waste gas from passing from the trapway 316, upstream through the passage 334 to the passage to the rim 308, and out through the rim outlet 314 or a tank at the inlet opening 304, where it would be released into the atmosphere contrary to code requirements without the water lock being present.

The passage upper peak 348 is disposed above the upper peak 330 of the trapway upper surface 324. In this configuration, when a siphon is formed in the trapway 316 and the water level in the trapway rises all the way to the upper peak 330, the waste water does not rise high enough to flow over the passage upper peak 348 and upstream through the passage 334 to the rim 308. This configuration is important to ensure that waste water does not recirculate through the passage 334 and back into the bowl 306 during a flush sequence.

The toilet 300 in FIG. 5 is shown with the water level in the bowl 306 at a first height (i.e., a first water level $WL_1$) corresponding to a filled position. As discussed above, when the flush sequence is complete, the water level is at the same height as the upper peak 330 of the trapway lower surface 328. When the flush sequence is actuated, a volume of water (e.g., approximately 1.0 gallons, 1.28 gallons, 1.6 gallons, etc.) is introduced rapidly through the inlet opening 304 and the inlet channel 312, into the rim 308. The high flow rate of water into the rim 308 reduces the pressure in the rim 308. According to an exemplary embodiment, a portion of the water introduced to the rim 308 passes directly into the passage 334 through the passage inlet 336, raising the water level of the water lock in the passage 334. As the water flows over the passage upper peak 348, a siphon is formed in the passage 334, continuing to draw water from rim 308 and output the water into the trapway 316. This additional flow of water may have a minimal effect in inducing the formation of a subsequent siphon in the trapway 316.

The remaining portion of the water introduced to the rim 308 then passes into the bowl 306 through the rim outlet(s) 314. It should be understood that according to other exemplary embodiments, a portion or all of the water in the rim 308 may be passed directly to the sump 310 (e.g., with a sump jet) or other portion of the toilet 300, rather than out through the rim outlet 314.

While water continues to be introduced to the rim 308, the rapid introduction of water to the bowl 306 causes the water level in the bowl 306 to rise to a second height (i.e., a second water level $WL_2$) above the upper peak 330 of the trapway lower surface 328 and below or in contact with the upper peak 326 of the trapway upper surface 324. The water then pours over the upper peak 330 of the trapway lower surface 328 and into the trapway down-leg 322, where it fills substantially an entire cross-section of at least a portion of the trapway down-leg 322 with a high flow rate. The increased flow rate of water in the trapway 316 reduces the downstream (e.g., in the trapway down-leg 322) pressure in the trapway 316 to a siphon pressure, which is less than an ambient pressure, causing a siphon to form, and evacuating the contents from the bowl 306.

After the siphon is formed in the trapway 316 and before the supply of water to the rim 308 is stopped, the siphon in the trapway 316 evacuates the water and waste in the bowl 306, through the trapway up-leg 320 and the trapway down-leg 322 and out to the drain. As water is pulled out of the bowl 306 with the siphon, the water level drops in the bowl 306. When the water level in the bowl 306 is at a third height (i.e., a third water level $WL_3$), between the upper peak 330 of the trapway lower surface 328 and the upper edge 332 of the trapway inlet 318 (i.e., before the water level in the bowl falls below the upper edge 332 of the trapway inlet 318), the supply of water to the rim 308 is stopped. Because water is no longer supplied to the rim 308, at least at a high enough rate to continue to fill the passage 334 at the rate that the passage 334 outputs water to the trapway 316, the siphon in the passage 334 continues to operate until the passage water level drops below the passage valley 344 or until all of the water in the passage 334 is evacuated.

The reduction of water in the rim 308 also returns the rim pressure to approximately ambient pressure. When the passage water level drops to or below the height of the passage valley 344, the entire passage 334 is exposed to the air in the rim 308 at ambient pressure. Because air at ambient pressure is at a higher pressure than the siphon pressure in the trapway 316 proximate the passage outlet 338, the air enters the passage 334 from the rim 308, through the passage inlet 336, and is output from the passage outlet 338 into the trapway 316. The sudden introduction of the air to the trapway 316 causes the pressure in the trapway 316 to equalize with ambient pressure, eliminating the pressure differential between the downstream portion of the trapway and the bowl 306, which is also at ambient pressure, thereby breaking (e.g., partially or completely) the siphon. Momentum from the water moving in the trapway up-leg 320 may continue to carry additional water and/or waste out of trapway up-leg 320 and/or the sump 310 for output to a drain.

According to another exemplary embodiment, after the water is stopped in the rim 308 and/or the siphon in the passage 334 is completed, it may take a period of time to fully equalize the pressure (i.e., eliminate the pressure differential) between the trapway 316 proximate the passage outlet 338 and ambient pressure. Notably, at least a portion of the trapway 316 may be at an intermediate pressure, which is greater than the siphon pressure and less than ambient pressure. While a pressure differential still exists between the intermediate pressure and ambient pressure, the siphon may continue at a slower rate and the water level will continue to drop. As the water level drops, it then reaches a fourth height (i.e., a fourth water level $WL_4$), which is at or below the height of the upper edge 332 of the trapway inlet 318. When the water level reaches the fourth height, ambient air then passes directly into the trapway 316 at the trapway inlet 318, completely breaking the siphon.

According to another exemplary embodiment, the passage inlet 336 may be disposed in the rim 308, such that water does not flow into the passage 334 when the water is first received in the rim 308 proximate the passage inlet 336. For example, the passage inlet 336 may be disposed in the rim upper surface 309, such that gravity prevents or limits the flush water from entering the passage inlet 336 during the flush sequence.

In this configuration, a siphon is not formed in the passage 334 due only to the introduction of water to the rim 308. Instead, while water is flowing through the rim 308 and the siphon is formed in the trapway 316, the water level in the passage 334 remains substantially constant, maintaining the water lock therein. For example, the reduced rim pressure may be approximately the same as or close to the siphon pressure in the trapway 316, resulting in little or no pressure differential between the passage inlet 336 and the passage outlet 338. The lack of pressure differential in the passage 334 prevents a substantial volume of water from flowing upstream or downstream in the passage 334.

After the siphon is formed in the trapway 316 and before the supply of water to the rim 308 is stopped, the siphon in the trapway 316 evacuates the water and waste in the bowl 306, through the trapway up-leg 320 and the trapway down-leg 322 and out to the drain. As water is pulled out of the bowl 306 with the siphon, the water level drops in the bowl 306. When the water level in the bowl 306 is at the third height, between the upper peak 330 of the trapway lower surface 328 and the upper edge 332 of the trapway inlet 318 (i.e., before the water level in the bowl falls below the upper edge 332 of the trapway inlet 318), the supply of water to the rim 308 is stopped.

When the water stops flowing into the rim 308, the rim pressure increases to approximately ambient pressure, forming a pressure differential between the passage inlet 336 at ambient pressure and the passage outlet 338 at the lower siphon pressure. This pressure differential causes the water in the passage 334 to flow downstream, through the passage outlet 338 and into the trapway 316, after water has stopped flowing through rim 308. According to yet another exemplary embodiment, the siphon pressure in the trapway 316 may be less than the rim pressure, such that the pressure differential causes the water in the passage 334 to flow downstream, even while water is flowing through the rim 308.

When the passage water level drops to or below the height of the passage valley 344, the entire passage 334 is exposed to the air in the rim 308 and therefore in the bowl 306 (via the rim outlet 314) above the water, which is at ambient pressure. Because air at ambient pressure is at a higher pressure than the siphon pressure in the trapway 316 proximate the passage outlet 338, the air enters the passage 334 from the rim 308, through the passage inlet 336, and is output from the passage outlet 338 into the trapway 316. The sudden introduction of the air to the trapway 316 causes the pressure in the trapway 316 to equalize with ambient pressure, eliminating the pressure differential between the downstream portion of the trapway 316 and the bowl 306, which is also at ambient pressure, thereby breaking (e.g., partially or completely) the siphon. Momentum from the water moving in the trapway up-leg 320 may continue to carry additional water and/or waste out of trapway up-leg 320 and/or the sump 310 for output to a drain.

In the event that enough water is evacuated from the passage 334, such that the passage water level is below the passage valley 344, water is supplied to the passage 334 through the passage inlet 336. The water may be supplied during a re-filling (e.g., resetting) portion or other portion of the flush sequence, causing the passage water level to rise. As the passage water level rises back above the passage valley 344, the water lock is formed once again in the passage 334 and prevents noxious waste gas from exiting the trapway 316, through the passage 334.

Figure 6:
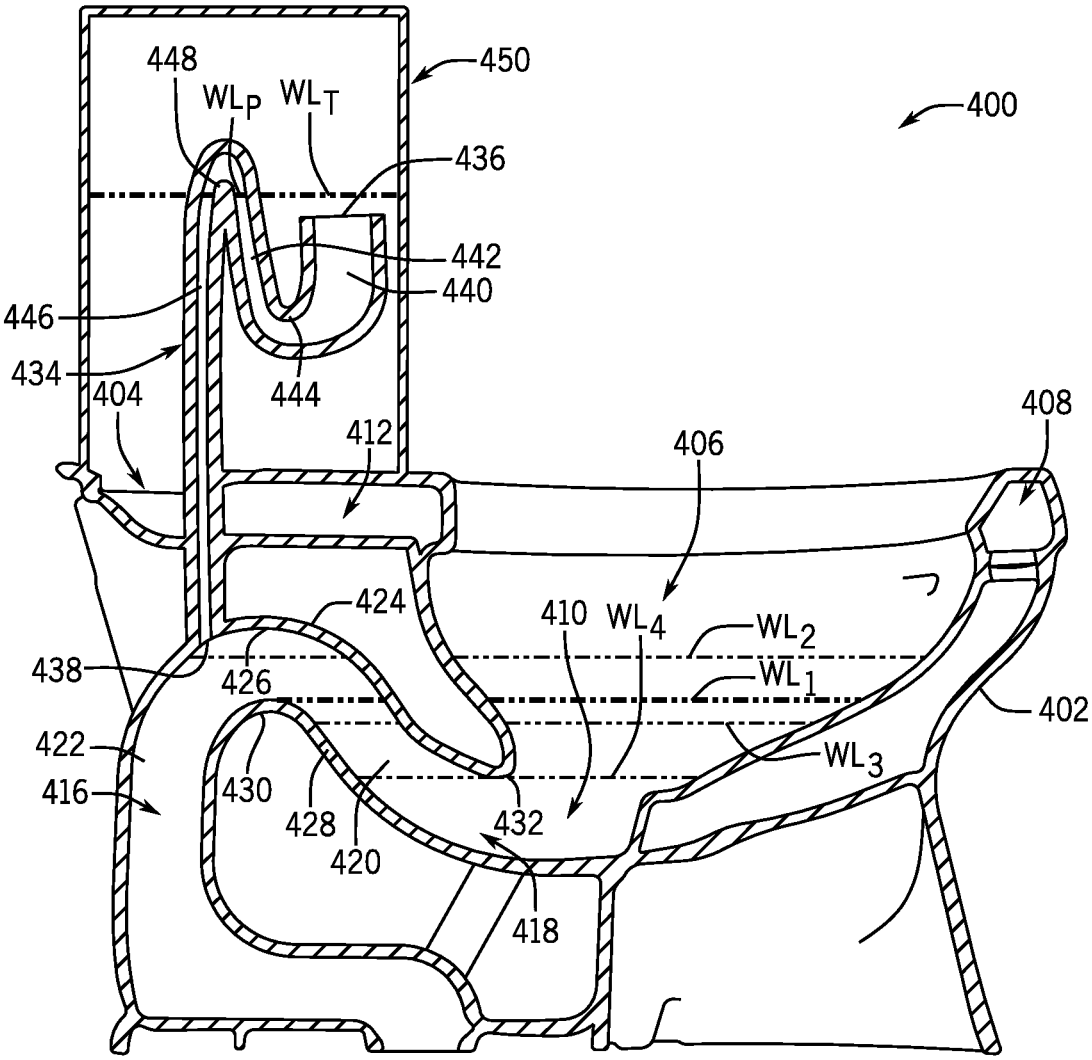
FIG. 6 is a cross-sectional view of a toilet with a trapway and a passage according to another exemplary embodiment.

Referring now to FIG. 6, a toilet 400 is shown according to an exemplary embodiment. The toilet 400 is substantially similar to the toilet 200 shown in FIGS. 2-4, such that like reference numerals may indicate like features and/or portions of the toilet 200. For example, the toilet 400 includes a pedestal 402, having an inlet opening 404, a rim 408, an inlet channel 412, a howl 406, a sump 410, and a trapway 416, which are substantially similar to the pedestal 202, inlet opening 204, rim 208, inlet channel 212 bowl 206, sump 210, and trapway 216, respectively of the toilet 200 shown in FIGS. 2-4.

Referring still to FIG. 6, the toilet 400 further includes a tank 450 disposed on the pedestal 402, such that the tank 450 is fluidly connected to the inlet opening 404 in the pedestal 402, for supplying water thereto. A passage 434 (i.e., break, bypass, vent, secondary passage or conduit, etc.) is shown according to an exemplary embodiment with various portions disposed in the tank 450 and the pedestal 402. The passage 434 includes a passage inlet 436 at an upstream end of the passage 434 and a passage outlet 438 at an opposing downstream end of the passage 434. The passage 434 passes through the pedestal 402 and fluidly connects the tank 450 and the tramway 416. It should be understood that while FIG. 6 shows the tank 450 disposed on the pedestal 402, according to other exemplary embodiments, the tank 450 may be remote from the pedestal 402 (e.g., installed and concealed within a wall) and still be fluidly connected to trapway 416.

As shown in FIG. 6, the passage inlet 436 is disposed (i.e., formed, defined, etc.) in the tank 450. The passage inlet 436 is disposed at a height that is higher than (i.e., above) the passage outlet 438. The passage outlet 438 is disposed (i.e., formed, defined, etc.) in and fluidly connected to the trapway 416. Specifically, the passage outlet 438 is disposed downstream from the upper peaks 426, 430 of the trapway 416 (e.g., in the trapway down-leg 422). According to another exemplary embodiment, the passage outlet 438 may be disposed upstream from the upper peaks 426, 430 (e.g., in the trapway up-leg 420), similarly to the configuration shown in FIG. 3. According to yet another exemplary embodiment, the passage outlet 438 may be disposed proximate the upper peaks 426, 430, similarly to the configuration shown in FIG. 5. While FIG. 6 shows the passage outlet 438 formed in the trapway upper surface 424, proximate the upper peak 426, it should be understood that according to other exemplary embodiments, the passage outlet 438 may be formed in the trapway lower surface 428 or other surfaces (e.g., side surfaces) of the trapway 416.

Referring still to FIG. 6, the passage 434 includes a passage first down-leg 440, which extends downstream from the passage inlet 436 (e.g., toward the passage outlet 438) at a downward angle (e.g., approximately vertically downward) relative to the floor. The passage 434 further includes a passage up-leg 442, which extends downstream from the passage first down-leg 440 at an upward angle. A passage valley (i.e., lower peak) 444 is defined at the lowermost (i.e., lowest) point of an upper surface of the passage 434 (e.g., where the passage first down-leg 440 meets the passage up-leg 442). The passage 434 further includes a passage second down-leg 446, which extends downstream from the passage up-leg 442 at a downward angle, through the tank 450 and pedestal 402, and terminates at the passage outlet 438 in the trapway 416. A passage upper peak 448 is defined at the uppermost (i.e., highest) point of a lower surface of the passage 434 (e.g., where the passage up-leg 442 meets the passage second down-leg 446).

As shown in FIG. 6, the passage valley 444 is disposed below the passage upper peak 448. The tank 450 includes a tank water level $WL_T$, when the tank 450 is fully filled with water at the end of a flush sequence and before being discharged into the bowl 406 and through the trapway 416 during a new flush sequence. As shown in FIG. 6, the passage inlet 436 is disposed level with or below the tank water level $WL_T$. For example, the tank water level $WL_T$ may be at the height of the passage upper peak 448, such that as the tank water level $WL_T$ rises above the passage upper peak 448, water flows over the passage upper peak 448, downstream through the passage second down-leg 446 and into the trapway 416 for discharge. In this configuration, the passage 434 also provides overflow protection in the tank 450, even if a refill valve in the tank 450 is stuck in an open position. According to another exemplary embodiment, the tank water level $WL_T$ may be set at a height above the passage inlet 436 and below the passage upper peak 448.

When the flush sequence is complete (i.e., in between flushes), water rests in the passage 434 at a passage water level $WL_P$, which is level with or below the passage upper peak 448 and above the passage valley 444. The water in the passage 434 is disposed in at least a portion of the passage first down-leg 440 and the passage up-leg 442. For example, as shown in FIG. 6, the passage water level $WL_P$ is at the same height as the tank water level $WL_T$, which is between the passage inlet 436 and the passage upper peak 448. The passage water level $WL_P$ forms a water lock in the passage 434 and prevents noxious waste gas from passing from the trapway 416, upstream through the passage 434 and into the tank 450, where it would be released into the atmosphere.

According to yet another exemplary embodiment, the passage inlet 436 may be disposed above the tank water level $WL_T$. In this configuration, after the water is evacuated from the tank 450 during the flush sequence, water is supplied to the tank 450 during a refilling portion of the flush sequence. The water is supplied through a water supply line (not shown), which has an outlet disposed in or directly above the passage inlet 436, into the passage 434, raising the passage water level $WL_P$ in the passage first down-leg 440 and the passage up-leg 442. When the passage water level $WL_P$ rises above the height of the passage inlet 436 but has not yet reached the passage upper peak 448, water starts to overflow from the passage 434 and into the tank 450 for filling the tank 450. In this configuration, after the siphon is broken in the trapway 416, the passage 434 seals with a water lock before the tank 450 is refilled with water, providing a water lock as soon as the passage water level $WL_P$ rises to a height level with or above the passage valley 444.

According to yet another exemplary embodiment, the passage inlet 436 may be disposed at a height above the passage upper peak 448. In this configuration, the tank water level $WL_T$ is level with or below the passage inlet 436. For example, as the tank water level $WL_T$ rises above the passage inlet 436, water overflows into the passage 434 until the passage water level $WL_T$ reaches the height of the passage upper peak 448, at which point it overflows downstream in the passage second down-leg 446 and into the trapway 416. In this configuration, the passage 434 may refill with water to form the water lock after the tank 450 is filled to the height of the passage inlet 436. According to another exemplary embodiment, the water supply line supplies water directly to both the passage 434 and the tank 450 during the refilling process, such that the tank water level $WL_T$ and the passage water level $WL_P$ rise at the same time. The water supply line may be configured to provide water in each of the tank 450 and the passage 434 to a pre-determined height.

The toilet 400 in FIG. 6 is shown with the water level in the bowl 406 at a first height (i.e., a first water level $WL_1$) corresponding to a filled position. As discussed above, when the flush sequence is complete, the water level is at the same height as the upper peak 430 of the trapway lower surface 428. When the flush sequence is actuated, a volume of water (e.g., approximately 1.0 gallons, 1.28 gallons, 1.6 gallons, etc.) is introduced rapidly from the tank 450, through the inlet opening 404 and the inlet channel 412, into the bowl 406.

While water continues to be introduced to the rim 408, the rapid introduction of water to the bowl 406 causes the water level in the bowl 406 to rise to a second height (i.e., a second water level $WL_2$) above the upper peak 430 of the trapway lower surface 428 and below or in contact with the upper peak 426 of the trapway upper surface 424. The water then flows over the upper peak 430 of the trapway lower surface 428 and into the trapway down-leg 422, where it fills substantially an entire cross-section of at least a portion of the trapway down-leg 422 with a high flow rate. The increased flow rate of water in the trapway 416 reduces the downstream (e.g., in the trapway down-leg 422) pressure in the trapway 416 to a siphon pressure, which is less than an ambient pressure, causing a siphon to form, and evacuating the contents from the bowl 406.

The tank 450 is provided at approximately ambient pressure, such that the pressure at the passage inlet 436 is approximately ambient pressure. After the siphon forms in the trapway 416, as discussed above, the siphon pressure in the trapway 416 and at the passage outlet 438 is less than the ambient pressure at the passage inlet 436. This pressure differential (i.e., pressure drop) in the passage 434 from the passage inlet 436 to the passage outlet 438 causes the water in the passage 434 to flow downstream from the passage inlet 436 toward the lower pressure passage outlet 438 and empty into the trapway 416.

After the siphon is formed in the trapway 416 and before the water in the passage 434 is fully output (i.e., evacuated) into the trapway 416, the siphon in the trapway 416 also evacuates the water and waste in the bowl 406, through the trapway up-leg 420 and the trapway down-leg 422 and out to the drain. As water is pulled out of the bowl 406 with the siphon, the water level drops in the bowl 406. When the water level in the bowl 406 is at a third height (i.e., a third water level $WL_3$), between the upper peak 430 of the trapway lower surface 428 and the upper edge 432 of the trapway inlet 418 (i.e., before the water level in the bowl falls below the upper edge 432 of the trapway inlet 418), the water in the passage 434 is fully evacuated, breaking (i.e., eliminating, removing, etc.) the water lock therein. According to another exemplary embodiment, the passage water level $WL_P$ falls below the passage valley 444.

When the water in the passage 434 is evacuated, the entire passage 434 is exposed to the air in the tank 450 at ambient pressure. Because air at ambient pressure is at a higher pressure than the siphon pressure in the trapway 416 proximate the passage outlet 438, the air enters the passage 434 from the tank 450, through the passage inlet 436, and is output from the passage outlet 438 into the trapway 416. The sudden introduction of the air to the trapway 416 causes the pressure in the trapway 416 to equalize with ambient pressure, eliminating the pressure differential between the downstream portion of the trapway and the bowl 406, which is also at ambient pressure, thereby breaking (e.g., partially or completely) the siphon. Momentum from the water moving in the trapway up-leg 420 may continue to carry additional water and/or waste out of trapway up-leg 420 and/or the sump 410 for output to a drain.

According to another exemplary embodiment, after the water is evacuated from the passage 434, it may take a period of time to fully equalize the pressure (i.e., eliminate the pressure differential) between the trapway 416 proximate the passage outlet 438 and ambient pressure. Notably, at least a portion of the trapway 416 may be at an intermediate pressure, which is greater than the siphon pressure and less than ambient pressure. While a pressure differential still exists between the intermediate pressure and ambient pressure, the siphon may continue at a slower rate and the water level will continue to drop. As the water level drops, it then reaches a fourth height (i.e., a fourth water level $WL_4$), which is at or below the height of the upper edge 432 of the trapway inlet 418. When the water level reaches the fourth height, ambient air then passes directly into the trapway 416 at the trapway inlet 418, completely breaking the siphon.

The length of the flush sequence from first initiating the evacuation of the tank 450 into the bowl 406, until the water is evacuated from the passage 434 may be controlled, at least in part, based on a height of the tank water level $WL_T$ relative to the height of the passage inlet 436 in the tank 450.

For example, as the passage inlet 436 is positioned lower in the tank 450 and further away from the tank water level $WL_T$, or in other words, as the tank water $WL_T$ is raised further above the passage inlet 436, it takes longer for the tank 450 to output enough water to the bowl 406 to cause the tank water level $WL_T$ to drop below the passage inlet 436, at which point the water in the passage 434 may be fully evacuated, exposing the trapway 416 to ambient pressure in the tank 450, which is approximately the same as the ambient pressure in an environment surrounding the toilet 400, through the passage 434. It should be further understood that in the configuration in which the tank water level $WL_T$ is above the passage inlet 436, if the siphon is formed in the trapway 416 before the tank water level $WL_T$ drops below the passage inlet 436, then a portion of the water in the tank 450 may be drawn into the passage 434 with the siphon formed therein, while the remaining water in the tank 450 is output to the bowl 406, as discussed above.

Figure 7:
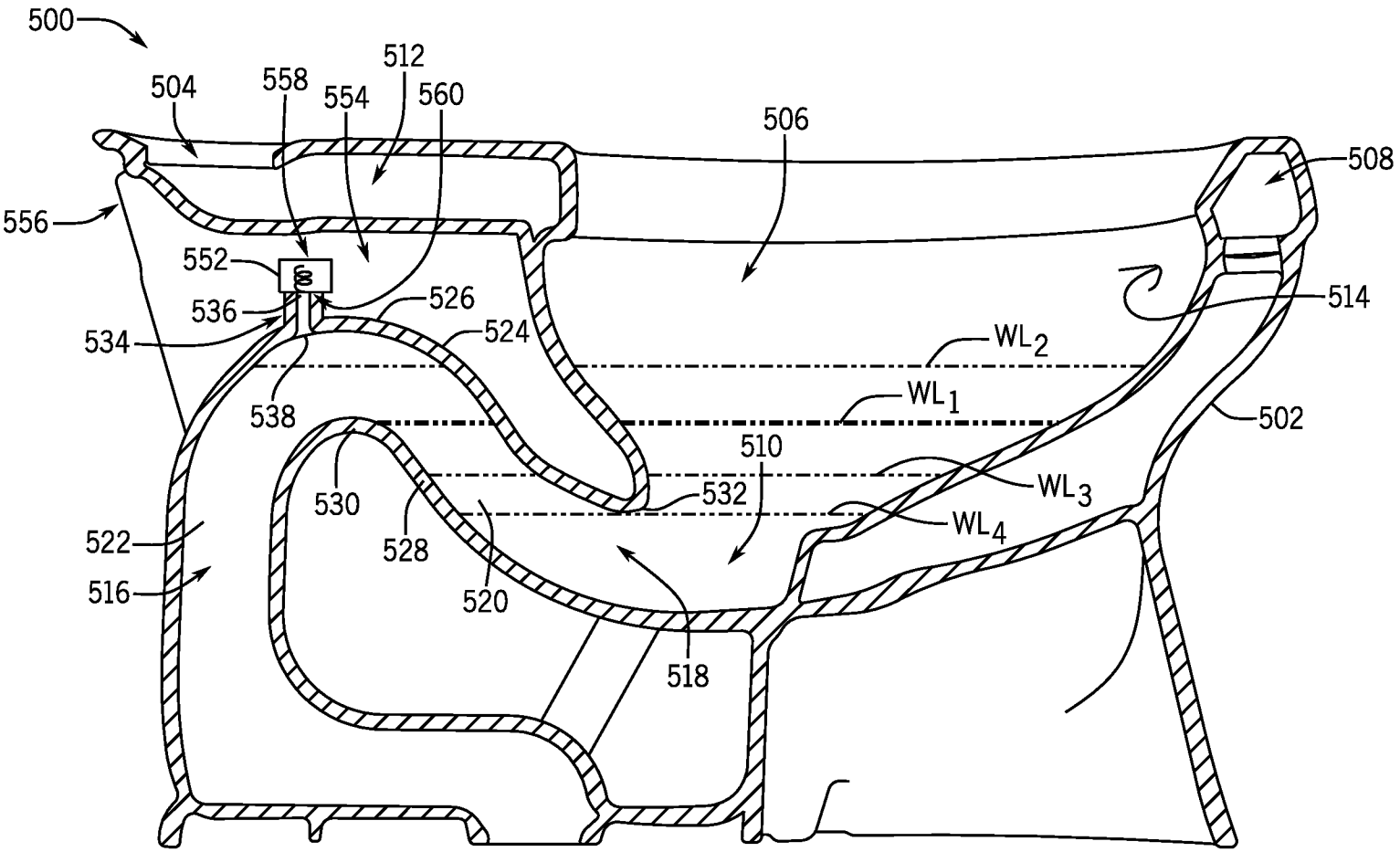
FIG. 7 is a cross-sectional view of a toilet with a trapway and a check valve according to an exemplary embodiment.

Referring now to FIG. 7, a toilet 500 is shown according to an exemplary embodiment. The toilet 500 is substantially similar to the toilet 200 shown in FIGS. 2-4, such that like reference numerals may indicate like features and/or portions of the toilet 200. For example, the toilet 500 includes a pedestal 502, having an inlet opening 504, a rim 508, an inlet channel 512, a bowl 506, a sump 510, and a trapway 516, which are substantially similar to the pedestal 202, inlet opening 204, rim 208, inlet, channel 212 bowl 206, sump 210, and trapway 216, respectively of the toilet 200 shown in FIGS. 2-4.

Referring still to FIG. 7, a passage 534 (i.e., break, bypass, vent, secondary passage or conduit, etc.) is shown according to an exemplary embodiment. The passage 534 includes a passage inlet 536 at an upstream end of the passage 534 and a passage outlet 538 at an opposing downstream end of the passage 534.

As shown in FIG. 7, the passage outlet 538 is disposed (i.e., formed, defined, etc.) in and fluidly connected to the trapway 516. Specifically, the passage outlet 538 is disposed downstream from the upper peaks 526, 530 of the trapway 516 (e.g., in the trapway down-leg 522). According to another exemplary embodiment, the passage outlet 538 may be disposed upstream from the upper peaks 526, 530 (e.g., in the trapway up-leg 520), similarly to the configuration shown in FIG. 3. According to yet another exemplary embodiment, the passage outlet 538 may be disposed proximate the upper peaks 526, 530, similarly to the configuration shown in FIG. 5. While FIG. 7 shows the passage outlet 538 formed in the trapway upper surface 524, proximate the upper peak 526, it should be understood that according to other exemplary embodiments, the passage outlet 538 may be formed in the trapway lower surface 528 or other surfaces (e.g., side surfaces) of the trapway 516.

The passage 534 extends generally upward from the trapway 516 toward the inlet channel 512 and the passage inlet 536 is disposed at a height higher than the passage outlet 538. However, it should be understood that the passage 534 may extend from the trapway 516 in other directions, having other lengths and the passage inlet 536 may be disposed at a height that is level with or below the passage outlet 538.

A valve 552 is disposed on and coupled to the passage inlet 536, upstream from the trapway 516, although according to other exemplary embodiments, the valve 552 may be disposed at another point along the passage 534 or may be disposed directly on the trapway 516 at or in place of the passage outlet 538, such that the valve 552 is fluidly connected to the trapway 516 in any of the positions of the passage outlet 538, as described above.

As shown in FIG. 7, the valve 552 is disposed in an interior portion 554 (e.g., void, space, etc.) of the pedestal 502, vertically between the trapway 516 and the inlet channel 512. A rear end 556 or other portion of the pedestal 502, which the interior portion 554 is open to the environment, such that the interior portion 554 is provided at approximately atmospheric pressure and the valve 552 is subject to atmospheric pressure. While FIG. 7 shows the valve 552 disposed within the pedestal 502 at the interior portion 554, it should be understood that according to other exemplary embodiments, the valve 552 may be disposed external to the pedestal 502 or the passage 534 may fluidly connect the valve 552 to a location external to the pedestal 502.

The valve 552 defines an upstream end 558 (i.e., a valve inlet), which is fluidly connected directly to the interior portion 554 or other location at ambient pressure, and a downstream end 560 (i.e., a valve outlet), which is fluidly connected directly to the passage 534 or the trapway 516. The valve 552 may be a check valve (i.e., a one-way valve), which is configured to allow air to flow in the direction from the upstream end 558 to the downstream end 560 and into the trapway 516 to break a siphon therein. The valve 552 may be configured to open when a pressure differential between the upstream end 558 and the downstream end 560 rises above a threshold pressure. In other words, when the pressure in the trapway 516 and therefore at the downstream end 560 of the valve 552 drops far enough due to the formation of the siphon in the trapway 516, the pressure differential forces the valve open after overcoming a biasing force (e.g., from a spring) that ordinarily keeps the valve 552 closed when the flush sequence is complete. When the pressure differential rises again after the siphon breaks in the trapway 516, the biasing force in the valve 552 (e.g., from the spring) forces the valve 552 back to the closed position, and prevents air from passing upstream or downstream through the valve 552 and into the trapway 516.

According to another exemplary embodiment, the valve 552 may be a solenoid (e.g., hydraulic, pneumatic, electric, etc.) or other type of valve 552, which is configured to open after the siphon is formed in the trapway 516. For example, the valve 552 may be coupled to a sensor (not shown) or other device, which indicates a drop in pressure in the trapway 516, which causes the valve 552 to open and then close when the pressure equalizes with ambient pressure or after a pre-determined or measured time delay. According to an exemplary embodiment, the sensor may include one or more pressure sensors, optical sensors, and/or conductivity sensors, which measure a pressure in the trapway 516 or other portion of the toilet 500. According to an exemplary embodiment, the valve 552 may open with the one or more sensors measure a first pre-determined threshold value and the valve 552 may subsequently close when the one or more sensors measure a second pre-determined threshold value. According to yet another exemplary embodiment, the valve 552 may be programmed to open and/or close based on a pre-determined or measured time delay following the actuation of a flush sequence.

The toilet 500 in FIG. 7 is shown with the water level in the bowl 506 at a first height (i.e., a first water level $WL_1$) corresponding to a filled position. As discussed above, when the flush sequence is complete, the water level is at the same height as the upper peak 530 of the trapway lower surface 528. When the flush sequence is actuated, a volume of water (e.g., approximately 1.0 gallons, 1.28 gallons, 1.6 gallons, etc.) is introduced rapidly through the inlet opening 504 and the inlet channel 512, into the bowl 506.

While water continues to be introduced to the rim 508, the rapid introduction of water to the bowl 506 causes the water level in the bowl 506 to rise to a second height (i.e., a second water level $WL_2$) above the upper peak 530 of the trapway lower surface 528 and below or in contact with the upper peak 526 of the trapway upper surface 524. The water then flows over the upper peak 530 of the trapway lower surface 528 and into the trapway down-leg 522, where it fills substantially an entire cross-section of at least a portion of the trapway down-leg 522 with a high flow rate. The increased flow rate of water in the trapway 516 reduces the downstream (e.g., in the trapway down-leg 522) pressure in the trapway 516 to a siphon pressure, which is less than an ambient pressure, causing a siphon to form, and evacuating the contents from the bowl 506.

After the siphon is formed in the trapway 516, the siphon evacuates the water and waste in the bowl 506, through the trapway up-leg 520 and the trapway down-leg 522 and out to the drain. As water is pulled out of the bowl 506 with the siphon, the water level drops in the bowl 506. When the water level in the bowl 506 is at a third height (i.e., a third water level $WL_3$), between the upper peak 530 of the trapway lower surface 528 and the upper edge 532 of the trapway inlet 518 (i.e., before the water level in the bowl falls below the upper edge 532 of the trapway inlet 518), the valve 552 opens. For example, the siphon pressure in the trapway 516 may fall below a threshold pressure, causing the valve 552 to open due to the pressure differential between the upstream end 558 and the downstream end 560 of the valve 552. According to another exemplary embodiment, the valve 552 is opened by an external mechanism. Because the valve 552 only opens when the pressure in the trapway 516 is less than the ambient pressure in the interior portion 554, the valve 552 prevents noxious waste gas from flowing upstream through the valve 552 from the trapway 516 and out from the pedestal 502 into the environment.

According to another exemplary embodiment, the passage 534 may further include at least one down-leg and at least one up-leg downstream from the at least one down-leg. For example, the passage 534 may have a configuration similar to the passage 234 shown in FIGS. 2-4. The passage 534 firms a water lock and the valve 552 may be disposed in the passage 534 in series with the water lock to further prevent the release of noxious gas into the environment. In this configuration, the valve 552 may be a conventional mechanical valve, rather than a one-way check valve, although other valves may be used.

When the valve 552 opens, the trapway 516 is exposed through the valve 552 to air from outside the pedestal 502 (e.g., an environment surrounding the pedestal 502) at ambient pressure. Because air at ambient pressure is at a higher pressure than the siphon pressure in the trapway 516 proximate the passage outlet 538, the air enters the passage 534 from the interior portion 554 of the pedestal 502, through the valve 552 and the passage inlet 536, and is output from the passage outlet 538 into the trapway 516. The sudden introduction of the air to the trapway 516 causes the pressure in the trapway 516 to equalize with ambient pressure, eliminating the pressure differential between the downstream portion of the trapway 516 and the bowl 506, which is also at ambient pressure, thereby breaking (e.g., partially or completely) the siphon. Momentum from the water moving in the trapway up-leg 520 may continue to carry additional water and/or waste out of trapway up-leg 520 and/or the sump 510 for output to a drain.

As the water level in the bowl 506 continues to drop, and the pressure in the trapway 516 approaches ambient pressure, the pressure differential across the valve 552 decreases, causing the valve 552 to close. According to other exemplary embodiments, the valve 552 may be closed in other ways. The valve 552 may close after the water level in the bowl 506 has dropped below the third height hut before it drops below a fourth height (i.e., a fourth water level $WL_4$), which is at or below the height of the upper edge 532 of the trapway inlet 518. According to another exemplary embodiment, the valve 552 may close after the water drops below the fourth height.

According to another exemplary embodiment, after the valve 552 opens, it may take a period of time to fully equalize the pressure (i.e., eliminate the pressure differential) between the trapway 516 proximate the passage outlet 538 and ambient pressure. Notably, at least a portion of the trapway 516 may be at an intermediate pressure, which is greater than the siphon pressure and less than ambient pressure. While a pressure differential still exists between the intermediate pressure and ambient pressure, the siphon may continue at a slower rate and the water level will continue to drop in the bowl 506. As the water level drops, it then reaches the fourth height, at which time ambient air then passes directly into the trapway 516 at the trapway inlet 518, completely breaking the siphon.

Figure 8:
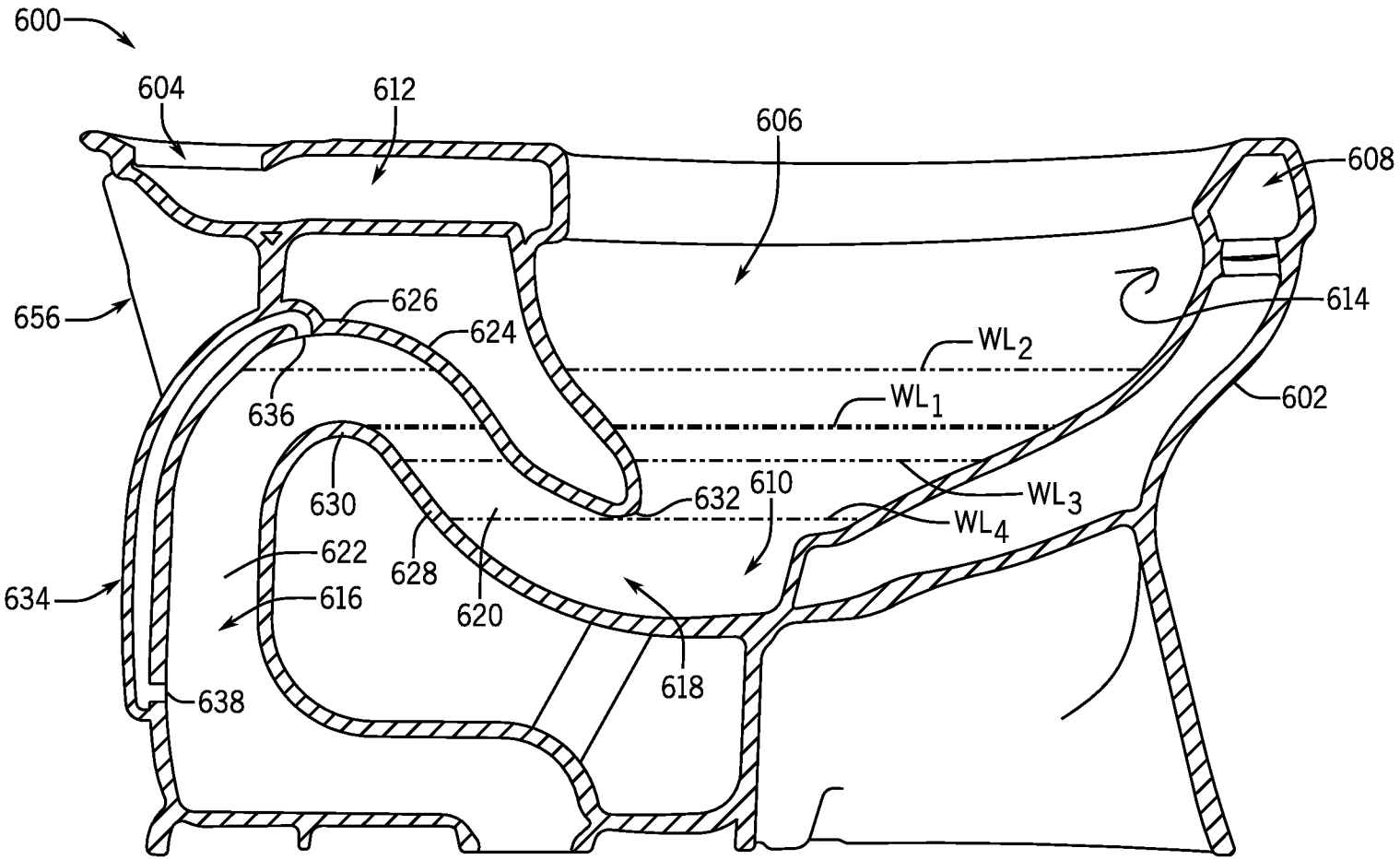
FIG. 8 is a cross-sectional view of a toilet with a trapway and a passage according to another exemplary embodiment.

Referring now to FIG. 8, a toilet 600 is shown according to an exemplary embodiment. The toilet 600 is substantially similar to the toilet 200 shown in FIGS. 2-4, such that like reference numerals may indicate like features and/or portions of the toilet 200. For example, the toilet 600 includes a pedestal 602, having an inlet opening 604, a rim 608, an inlet channel 611, a bowl 606, a sump 610, and a trapway 616, which are substantially similar to the pedestal 202, inlet opening 204, rim 208, inlet channel 212 bowl 206, sump 210, and trapway 216, respectively of the toilet 200 shown in FIGS. 2-4.

Referring still to FIG. 8, a passage 634 (i.e., break, bypass, vent, secondary passage or conduit, etc.) is shown according to an exemplary embodiment. The passage 634 includes a passage inlet 636 at an upstream end of the passage 634 and a passage outlet 638 at an opposing downstream end of the passage 634. The passage 634 is disposed in the pedestal 602, between and fluidly connecting different portions of the trapway 616. It should be understood that, according to various exemplary embodiments, the passage 634 be formed in a toilet in place of or in addition to (e.g., in combination with) any of the foregoing passages 134, 234, 334, 434, 534, described above.

As shown in FIG. 8, the passage inlet 636 is disposed (i.e., formed, defined, etc.) in the trapway 616 and the passage outlet 638 is also disposed in the trapway 616 downstream from the passage inlet 636. As shown in FIG. 8, the passage inlet 636 and the passage outlet 638 are disposed in the trapway down-leg 622. Specifically, the passage inlet 636 is disposed proximate an upstream end of the trapway down-leg 622, proximate and downstream from the upper peaks 626, 630 of the trapway 616. While FIG. 8 shows the passage inlet 636 formed in the trapway upper surface 624, proximate the upper peak 626, it should be understood that according to other exemplary embodiments, the passage inlet 636 may be formed in the trapway lower surface 628 or other surfaces (e.g., side surfaces) of the trapway 616. According to yet another exemplary embodiment, the passage inlet 636 may be disposed in any portion of the trapway up-leg 620, proximate or upstream from the upper peaks 626, 630. Regardless of the location of the passage inlet 636 in the trapway 616, the passage inlet 636 is disposed in the trapway 616 upstream from the passage outlet 638 and closer to the trapway inlet 618.

Referring still to FIG. 8, the passage outlet 638 is disposed proximate a downstream end of the trapway down-leg 622, such that, the passage outlet 638 is in the trapway 616 downstream from the passage inlet 636 and closer to a drain. While FIG. 8 shows the passage outlet 638 formed in a rear end 656 of the pedestal 602, it should be understood that according to other exemplary embodiments, the passage outlet 638 may be formed in other surfaces (e.g., side surfaces, forward surfaces, etc.) of the trapway 616. According to yet another exemplary embodiment, the passage inlet 636 may be disposed in any portion of the trapway up-leg 620, such that the passage inlet 636 is still disposed in the trapway 616 downstream from the passage inlet 636.

The toilet 600 in FIG. 8 is shown with the water level in the bowl 606 at a first height (i.e., a first water level $WL_1$) corresponding to a filled position. As discussed above, when the flush sequence is complete, the water level is at the same height as the upper peak 630 of the trapway lower surface 628. As shown in FIG. 8, when the water level is at the first height, the entire passage 634 is downstream from the upper peak 630 of the trapway lower surface 628, such that neither the passage inlet 636 nor the passage outlet 638 are disposed below the water level. Because the water level is above the upper edge 632 of the trapway inlet 618, forming a water lock in the trapway 616, the passage 634, which is downstream from the water lock in the trapway 616, does not require its own independent water lock to prevent noxious waste gas from exiting the trapway 616, through the passage 634, to the environment.

While FIG. 8 shows the entire passage 634 downstream from the water level at the first height, it should be understood that according to other exemplary embodiments, one or both of the passage inlet 636 and the passage outlet 638 may be disposed in the trapway up-leg 620, at a height below the upper peak 630 of the trapway lower surface 628 and above the upper edge 632 of the trapway inlet 618.

When the flush sequence is actuated, a volume of water (e.g., approximately 1.0 gallons, 1.28 gallons, 1.6 gallons, etc.) is introduced rapidly through the inlet opening 604 and the inlet channel 612, into the bowl 606. While water continues to be introduced to the rim 608, the rapid introduction of water to the bowl 606 causes the water level in the bowl 606 to rise to a second height (i.e., a second water level $WL_2$) above the upper peak 630 of the trapway lower surface 628 and below or in contact with the upper peak 626 of the trapway upper surface 624. The water then flows over the upper peak 630 of the trapway lower surface 628 and into the trapway down-leg 622, where it fills substantially an entire cross-section of at least a portion of the trapway down-leg 622 with a high flow rate. According to an exemplary embodiment, the laminar flow of the water in the trapway 616 prevents the water from separating and flowing into the passage inlet 636 and into the passage 634. According to another exemplary embodiment, the water may flow through the passage 634 alongside the trapway 616. The increased flow rate of water in the trapway 616 and/or the passage 634 reduces the downstream (e.g., in the trapway down-leg 622) pressure in the trapway 616 and/or in the passage 634 to a siphon pressure, which is less than an ambient pressure, causing a siphon to form, and evacuating the contents from the bowl 606.

After the siphon is formed in the trapway 616, the siphon evacuates the water and waste in the bowl 606, through the trapway up-leg 620 and the trapway down-leg 622 and out to the drain. As water is pulled out of the bowl 606 with the siphon, the water level drops in the bowl 606 until it reaches a third height (i.e., a third water level $WL_3$), which is at or below the height of the upper edge 632 of the trapway inlet 618. When the water level reaches the fourth height, the trapway 616 is suddenly exposed to air at ambient pressure in the bowl 606. This air passes above the water, between the water and the upper edge 632 of the trapway inlet 618, downstream through the trapway 616. As the air (e.g., an air pocket) flows downstream in the trapway 616, the pressure in the trapway 616 at a leading edge of the air (e.g., a trailing edge of the siphon water) increases to ambient pressure, while water further downstream from the leading edge maintains the lower siphon pressure.

When the air in the trapway reaches the passage inlet 636, the pressure in the passage 634 suddenly increases to the ambient pressure of the air, including at the passage outlet 638. The passage 634 has a smaller cross-sectional area than the trapway 616 and has less water than the trapway 616 or no water flowing therethrough, which allows the pressure in the entire passage 634 over the distance between the passage inlet 636 and the passage outlet 638 to equalize faster than the flow of air directly through the trapway 616. According to another exemplary embodiment, an internal length of the trapway 616 between the passage inlet 636 and the passage outlet 638 may be longer than an internal length of the passage 634 between the passage inlet 636 and the passage outlet 638, such that air takes less time to travel through the passage 634 than through the trapway 616 between the passage inlet 636 and the passage outlet 638. In either configuration, air at ambient pressure is output from the passage 634, through the passage outlet 638, into the trapway 616 downstream from the leading edge of the air received directly in the trapway 616. This introduction of air further breaks (e.g., partially or completely) the siphon in the trapway 616 or at least slows the volume flow rate of water and waste through the trapway 616 until the air received directly in the trapway 616 completely breaks the siphon therein. Momentum from the water moving in the trapway up-leg 620 may continue to carry additional water and/or waste out of trapway up-leg 620 and/or the sump 610 for output to a drain.

In this and other configurations, the air reintroduced to the trapway 616 through the passage 634 reduces the pressure differential between the tramway 616 (e.g., at the siphon pressure) and ambient pressure at a slower rate than a toilet without the passage 634. By slowing down this process, less turbulence is generated in the water in the trapway 616, reducing the noise generated in the toilet 600 generally or the trapway 616 more specifically when the siphon is broken.

As utilized herein, the terms "approximately," "about," "substantially," and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed are considered to be within the scope of this disclosure as recited in the appended claims.

It should be noted that the term "exemplary" as used herein to describe various embodiments is intended to indicate that such embodiments are possible examples, representations, and/or illustrations of possible embodiments (and such term is not intended to connote that such embodiments are necessarily extraordinary or superlative examples).

The terms "coupled," "connected," and the like as used herein mean the joining of two members directly or indirectly to one another. Such joining may be stationary (e.g., permanent) or moveable (e.g., removable or releasable). Such joining may be achieved with the two members or with the two members and any additional intermediate members being integrally formed as a single unitary body with one another or with the two members or the two members and any additional intermediate members being attached to one another.

References herein to the position of elements (e.g., "top," "bottom," "above," "below," etc.) are merely used to describe the orientation of various elements in the FIGURES. It should be noted that the orientation of various elements may differ according to other exemplary embodiments, and that such variations are intended to be encompassed by the present disclosure.

It is to be understood that although the present invention has been described with regard to preferred embodiments thereof, various other embodiments and variants may occur to those skilled in the art, which are within the scope and spirit of the invention, and such other embodiments and variants are intended to be covered by corresponding claims. Those skilled in the art will readily appreciate that many modifications are possible (e.g., variations in sizes, dimensions, structures, shapes and proportions of the various elements, values of parameters, mounting arrangements, use of materials, orientations, manufacturing processes, etc.) without materially departing from the novel teachings and advantages of the subject matter described herein. For example, the order or sequence of any process or method steps may be varied or re-sequenced according to alternative embodiments. Other substitutions, modifications, changes and omissions may also be made in the design, operating conditions and arrangement of the various exemplary embodiments without departing from the scope of the present disclosure.

We claim:

1. A toilet comprising:

a bowl;

a trapway including a trapway inlet connected at a lower end of the bowl and extending downstream from the bowl; and a bypass passage connected to the trapway, wherein ambient air is introduced to the trapway through the bypass passage.

2. The toilet of claim 1, wherein the ambient air flows through the bypass passage as a result of a pressure differential between the trapway and an ambient environment.

3. The toilet of claim 1, further comprising:

a tank as a water source for flushing the bowl, wherein the ambient air flows through the bypass passage as a result of a pressure differential between the trapway and a pressure level of a tank.

4. The toilet of claim 1, further comprising:

a valve coupled to the bypass passage, wherein the valve selectively connects atmospheric air pressure to the bypass passage.

5. The toilet of claim 4, further comprising:

a pedestal, wherein the bypass passage is disposed in the pedestal, wherein the valve is disposed at an interior space of the pedestal.

6. The toilet of claim 4, wherein the valve is a one-way valve that allows air flows from an environment of the toilet to the trapway.

7. The toilet of claim 4, further comprising:

a sensor configured to detect pressure in the trapway; and a solenoid, wherein the solenoid is configured to open the valve in response to the detected pressure in the trapway.

8. The toilet of claim 1, wherein the bypass passage is connected to the trapway at a timing position configured to break a siphon in the trapway.

9. The toilet of claim 8, wherein the timing position causes the siphon to break at a predetermined time in a flush sequence.

10. The toilet of claim 1, wherein the bypass passage extends at least partially upwardly from an upper surface of the toilet proximate to an inlet of the toilet.

11. A water and air passage network for a toilet, the passage network comprising:

a trapway including a trapway inlet connected at a lower end of the toilet; and a bypass passage connected to the trapway, wherein ambient air is introduced to the trapway through the bypass passage.

12. The water and air passage network of claim 11, wherein the ambient air flows through the bypass passage as a result of a pressure differential between the trapway and an ambient environment.

13. The water and air passage network of claim 11, further comprising:

a tank as a water source for flushing the toilet, wherein the ambient air flows through the bypass passage as a result of a pressure differential between the trapway and a pressure level of a tank.

14. The water and air passage network of claim 11, further comprising:

a valve coupled to the bypass passage, wherein the valve selectively connects atmospheric air pressure to the bypass passage.

15. The water and air passage network of claim 11, wherein the valve is a one-way valve that allows air flows from an environment of the toilet to the trapway.

16. The water and air passage network of claim 11, further comprising:

a sensor configured to detect pressure in the trapway; and a solenoid, wherein the solenoid is configured to open the valve in response to the detected pressure in the trapway.

17. The water and air passage network of claim 11, wherein the bypass passage is connected to the trapway at a timing position configured to break a siphon in the trapway, wherein the timing position causes the siphon to break at a predetermined time in a flush sequence.

18. The water and air passage network of claim 11, wherein the bypass passage extends at least partially upwardly from an upper surface of the toilet proximate to an inlet of the toilet.

19. A method for a flush sequence of a toilet, the method comprising:

starting the flush sequence of the toilet;

generating a siphon in a trapway of the toilet; and exposing the trapway to air through a bypass passage connected atmospheric pressure and connected to the trapway.

20. The method of claim 19, further comprising:
breaking the siphon in the trapway.

* * * * *